US009626926B2

(12) United States Patent
Izawa et al.

(10) Patent No.: US 9,626,926 B2
(45) Date of Patent: Apr. 18, 2017

(54) LIQUID CRYSTAL DISPLAY DEVICE

(71) Applicant: JVC KENWOOD Corporation, Yokohama-shi (JP)

(72) Inventors: Shunsuke Izawa, Tokyo (JP); Hirotomo Itou, Yokosuka (JP); Takayuki Iwasa, Yokohama (JP)

(73) Assignee: JVC KENWOOD Corporation, Yokohama-shi (JP)

( * ) Notice: Subject to any disclaimer, the term of this patent is extended or adjusted under 35 U.S.C. 154(b) by 75 days.

(21) Appl. No.: 14/260,022

(22) Filed: Apr. 23, 2014

(65) Prior Publication Data

US 2014/0320477 A1 Oct. 30, 2014

(30) Foreign Application Priority Data

Apr. 26, 2013 (JP) ..... 2013-093541

(51) Int. Cl.
*G09G 3/36* (2006.01)
*G09G 3/20* (2006.01)

(52) U.S. Cl.
CPC ..... *G09G 3/3655* (2013.01); *G09G 3/2022* (2013.01); *G09G 3/3659* (2013.01); (Continued)

(58) Field of Classification Search
CPC ..... G09G 3/3607
See application file for complete search history.

(56) References Cited

U.S. PATENT DOCUMENTS 5,349,366 A * 9/1994 Yamazaki ..... G09G 3/3648 345/206
5,712,652 A * 1/1998 Sato ..... G06F 3/03542 345/204

(Continued)

FOREIGN PATENT DOCUMENTS

JP 2001-523847 A 11/2001
JP 2002-515606 A 5/2002
JP 2004200300 A * 7/2004

OTHER PUBLICATIONS

Definition of capacity downloaded from http://www.thefreedictionary.com/capacity, Sep. 28, 2015, pp. 1-9.*

*Primary Examiner* — Dorothy Harris
(74) *Attorney, Agent, or Firm* — Venable LLP; Michael A. Sartori; Laura G. Remus

(57) ABSTRACT

Provided is a liquid crystal display device that includes: pixels, a pixel control unit, and a common voltage generation unit. The pixel includes: a display element; a first switching unit configured to sample each frame data; a first holding unit configured to form an SRAM, and to hold sub-frame data sampled; a second switching unit configured to output the sub-frame data; and a second holding unit configured to form a DRAM, and configured of which stored content is rewritten by the sub-frame data. The pixel control unit is configured to repeat writing the sub-frame data into the first holding units, and to operate to rewrite the stored content in the second holding units. The common voltage generation unit is configured to change a voltage value of a common voltage from a first voltage value to a second voltage value determined based on at least the one frame period.

8 Claims, 12 Drawing Sheets

| FRAME / GRADATION | i | i+1 | i+2 | i+3 | i+4 | i+5 | i+6 | i+7 | DC BALANCE |
|---|---|---|---|---|---|---|---|---|---|
| n | $T_n$ | $-T_n$ | $T_n$ | $-T_n$ | $-T_n$ | $T_n$ | $-T_n$ | $T_n$ | 0 |
| n+0.25 | $T_{n+1}$ | $-T_n$ | $T_n$ | $-T_n$ | $-T_{n+1}$ | $T_n$ | $-T_n$ | $-T_n$ | 0 |
| n+0.5 | $T_{n+1}$ | $-T_{n+1}$ | $T_n$ | $-T_n$ | $-T_{n+1}$ | $T_{n+1}$ | $-T_n$ | $T_n$ | 0 |
| n+0.75 | $T_{n+1}$ | $-T_{n+1}$ | $T_{n+1}$ | $-T_n$ | $-T_{n+1}$ | $T_{n+1}$ | $-T_{n+1}$ | $T_n$ | 0 |

(52) U.S. Cl.
CPC ..... *G09G 2300/0809* (2013.01); *G09G 2300/0857* (2013.01)

(56) References Cited

U.S. PATENT DOCUMENTS

| | | | | | |
|---|---|---|---|---|---|
| 5,959,598 | A * | 9/1999 | McKnight | G06T 3/40 | 345/87 |
| 6,005,558 | A * | 12/1999 | Hudson | G09G 3/3614 | 345/204 |
| 7,663,578 | B2 * | 2/2010 | Miyake | G09G 3/3258 | 315/169.3 |
| 8,049,702 | B2 * | 11/2011 | Miyazawa | G09G 3/3659 | 345/100 |
| 2001/0005193 | A1 * | 6/2001 | Yokoyama | G09G 3/2011 | 345/92 |
| 2001/0052890 | A1 * | 12/2001 | Miyazawa | G09G 3/3659 | 345/89 |
| 2002/0075252 | A1 * | 6/2002 | Lee | G09G 3/3659 | 345/211 |
| 2002/0084967 | A1 * | 7/2002 | Akimoto | G09G 3/3648 | 345/90 |
| 2004/0196235 | A1 * | 10/2004 | Koyama | G09G 3/3607 | 345/89 |
| 2004/0263939 | A1 * | 12/2004 | Yano | G09G 3/3648 | 359/238 |
| 2007/0285383 | A1 * | 12/2007 | Iizuka | G02F 1/13454 | 345/103 |
| 2008/0238850 | A1 * | 10/2008 | Watanabe | G09G 3/3614 | 345/90 |
| 2008/0309656 | A1 * | 12/2008 | Van Woudenberg | G09G 3/3614 | 345/214 |
| 2009/0096947 | A1 * | 4/2009 | Teranishi | G02F 1/13306 | 349/38 |

* cited by examiner

106: FIRST METAL
108: SECOND METAL
110: THIRD METAL
112: ELECTRODE
114: FOURTH METAL
116: FIFTH METAL

118: CONTACT
119a TO 119e: THROUGH HOLE

FIG.10A

| FRAME / GRADATION | i | i+1 | DC BALANCE |
|---|---|---|---|
| n | $T_n$ | $T_n$ | $2T_n$ |
| n+1 | $T_{n+1}$ | $T_{n+1}$ | $2T_{n+1}$ |

FIG.10B

| FRAME / GRADATION | i | i+1 | DC BALANCE |
|---|---|---|---|
| n | $T_n$ | $-T_n$ | 0 |
| n+1 | $T_{n+1}$ | $-T_{n+1}$ | 0 |

FIG.11

| FRAME / GRADATION | i | i+1 | i+2 | i+3 |
|---|---|---|---|---|
| n | n | n | n | n |
| n+0.25 | n+1 | n | n | n |
| n+0.5 | n+1 | n+1 | n | n |
| n+0.75 | n+1 | n+1 | n+1 | n |

FIG.14

| FRAME / GRADATION | i | i+1 | i+2 | i+3 | i+4 | i+5 | i+6 | i+7 | DC BALANCE |
|---|---|---|---|---|---|---|---|---|---|
| n | $T_n$ | $-T_n$ | $T_n$ | $-T_n$ | $T_n$ | $-T_n$ | $T_n$ | $-T_n$ | 0 |
| n+0.25 | $T_{n+1}$ | $-T_n$ | $T_n$ | $-T_n$ | $T_{n+1}$ | $-T_n$ | $T_n$ | $-T_n$ | $2T_{n+1}-2T_n$ |
| n+0.5 | $T_{n+1}$ | $-T_{n+1}$ | $T_n$ | $-T_n$ | $T_{n+1}$ | $-T_{n+1}$ | $T_n$ | $-T_n$ | 0 |
| n+0.75 | $T_{n+1}$ | $-T_{n+1}$ | $T_{n+1}$ | $-T_n$ | $T_{n+1}$ | $-T_{n+1}$ | $T_{n+1}$ | $-T_n$ | $2T_{n+1}-2T_n$ |

FIG.15

| FRAME / GRADATION | i | i+1 | i+2 | i+3 | i+4 | i+5 | i+6 | i+7 | DC BALANCE |
|---|---|---|---|---|---|---|---|---|---|
| n | $T_n$ | $-T_n$ | $T_n$ | $-T_n$ | $-T_n$ | $T_n$ | $-T_n$ | $T_n$ | 0 |
| n+0.25 | $T_{n+1}$ | $-T_n$ | $T_n$ | $-T_n$ | $-T_{n+1}$ | $T_n$ | $-T_n$ | $-T_n$ | 0 |
| n+0.5 | $T_{n+1}$ | $-T_{n+1}$ | $T_n$ | $-T_n$ | $-T_{n+1}$ | $T_{n+1}$ | $-T_n$ | $T_n$ | 0 |
| n+0.75 | $T_{n+1}$ | $-T_{n+1}$ | $T_{n+1}$ | $-T_n$ | $-T_{n+1}$ | $T_{n+1}$ | $-T_{n+1}$ | $T_n$ | 0 |

LIQUID CRYSTAL DISPLAY DEVICE

CROSS-REFERENCE TO RELATED APPLICATIONS

The present application claims priority to and incorporates by reference the entire contents of Japanese Patent Application No. 2013-093541 filed in Japan on Apr. 26, 2013.

BACKGROUND OF THE INVENTION

1. Field of the Invention

The present invention relates to a liquid crystal display device, and especially relates to a liquid crystal display device that performs gradation display by a combination of a plurality of sub-frames according to a gradation level expressed by a plurality of bits.

2. Description of the Related Art

Conventionally, a system of driving sub-frames is known as a half-tone display system in a liquid crystal display device. In the system of driving sub-frames that is one type of a time axis modulation system, a predetermined period (for example, one frame as a display unit of one image in a case of a moving image) is divided into a plurality of sub-frames, and driving of each pixel is performed by a combination of the sub-frames in accordance with a gradation to be displayed. The gradation to be displayed is determined based on a ratio of a driving period of a pixel to a predetermined period. The ratio of a driving period of a pixel to a predetermined period is determined by a combination of the divided sub-frames.

As a liquid crystal display device that employs the system of driving sub-frames described above, one disclosed in Japanese Translation of PCT International Application Publication No. JP-T-2001-523847 is known, for example, in which each pixel is configured from a master latch, a slave latch, a liquid crystal display element, and first to third as a total of three switching transistors. In this case, in each pixel, one-bit first data is applied to one of two input terminals of the master latch through the first switching transistor; and one-bit second data that is in a complementary relation with the first data is applied to the other input terminal through the second switching transistor. Then, when an object pixel is selected based on an application of a row selection signal through a row scanning line, these first and second switching transistors are turned ON, and the first data is written. When the first data is a logical value "1," and the second data is a logical value "0," display based on the pixel data is performed.

After data are written to all of the pixels by an operation as described above within a sub-frame period, third switching transistors of all of the pixels are turned ON in the sub-frame period. Then, the data written in the master latch are simultaneously read out to the slave latches. Then, the slave-latched data applies the data latched in the slave latch to the pixel electrode of the liquid crystal display element. The series of operations are repeated for each sub-frame, and desired gradation is performed based on a combination of all of the sub-frames in one frame period.

That is, in the liquid crystal display device that employs the system of driving sub-frames, with respect to all of the sub-frames existing in one frame period, the same or a different predetermined display period is allocated to each sub-frame. Then, each pixel performs white display in all of the sub-frames at the maximum gradation display (display is performed); while each pixel does not perform white display in all of the sub-frames at the minimum gradation display (non-display, that is, black display is performed). In cases other than the maximum gradation display and the minimum gradation display, sub-frames to be white-displayed are selected according to a gradation to be white-displayed. Note that the conventional liquid crystal display device uses a digital driving system having a two-stage latch configuration, where input data is digital data that indicates a gradation.

Here, typically, in a liquid crystal display device, it is necessary to perform AC drive in which positive and negative voltages are alternately applied to a common electrode of a substrate, which opposes a pixel electrode, by about 1 kHz in order to prevent deterioration of the liquid crystal element (for example, deterioration due to burning). At this time, it is necessary to invert the polarity of the pixel electrode in accordance with the polarity of the common electrode. However, in the liquid crystal display device using the above digital driving system having a two-stage lath configuration, inverted data needs to be rewritten again with respect to a pixel circuit.

Therefore, for example, Japanese Translation of PCT International Application Publication No. JP-T-2002-515606 W discloses a liquid crystal display device that has a configuration in which a pair of voltage supply terminals that supply a voltage corresponding to the positive and negative polarities are provided in addition to a pixel circuit, and in which a multiplexer for selectively connecting one or the other of the voltage supply terminals is included. According to the configuration, it is not necessary to rewrite the inverted data again, and the polarity of the pixel electrode can be inverted in accordance with the polarity of the common electrode.

However, in the conventional liquid crystal display device as described above, each of the two latches in each pixel is configured from a static random access memory (SRAM) and therefore, the number of transistors that configures the circuit increases. In addition, if the configuration includes a multiplexer in addition to the two latches, the number of transistors further increases. Therefore, there is a problem that the downsizing of the pixel is difficult.

Meanwhile, in a case where a configuration not including the multiplexer is employed in order to decrease the number of transistors, the AC drive is performed by rewriting the inverted data into the pixel circuit. In this case, there is a difference between application times of the positive polarity and the negative polarity depending on the gradation of the pixel, and thus display deterioration due to burning may occur. To avoid the problem, there is a method of equalizing the positive and negative application times by driving, using a pair of equal positive and negative sub-frame periods. However, there are problems that the number of combinations of sub-frames is decreased by half, and the gradation performance is deteriorated.

There is a need to at least partially solve the problems in the conventional technology.

SUMMARY OF THE INVENTION

Provided is a liquid crystal display device that includes: a plurality of pixels, a pixel control unit, and a common voltage generation unit. The pixel includes: a display element; a first switching unit configured to sample each frame data of an input video signal using a plurality of sub-frames having a shorter display period than one frame period; a first holding unit configured to form an SRAM together with the first switching unit, and to hold sub-frame data sampled; a second switching unit configured to output the sub-frame data; and a second holding unit configured to form a DRAM together with the second switching unit, configured of which stored content is rewritten by the sub-frame data held in the first holding unit and input through the second switching unit. The pixel control unit is configured to repeat writing the sub-frame data into the first holding units, to turn ON the second switching units by a trigger pulse after the sub-frame data have been written into all of the plurality of pixels, and to operate, for each sub-frame, to rewrite the stored content in the second holding units. The common voltage generation unit is configured to change a voltage value of a common voltage from a first voltage value to a second voltage value within a predetermined period determined based on at least the one frame period.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIGS. 10A and 10B are tables illustrating liquid crystal applied voltage balance in two frame periods in the liquid crystal display device;

FIG. 11 is an example illustrating gradation data in a typical FRC processing in each frame;

FIG. 14 is a table illustrating liquid crystal applied voltage balance in eight frame periods in a case where the FRC signal processing is applied in the liquid crystal display device;

FIG. 15 is a table illustrating liquid crystal applied voltage balance in eight frame periods in a case where the FRC signal processing is applied in the liquid crystal display device;

DETAILED DESCRIPTION OF THE PREFERRED EMBODIMENTS

Figure 1:
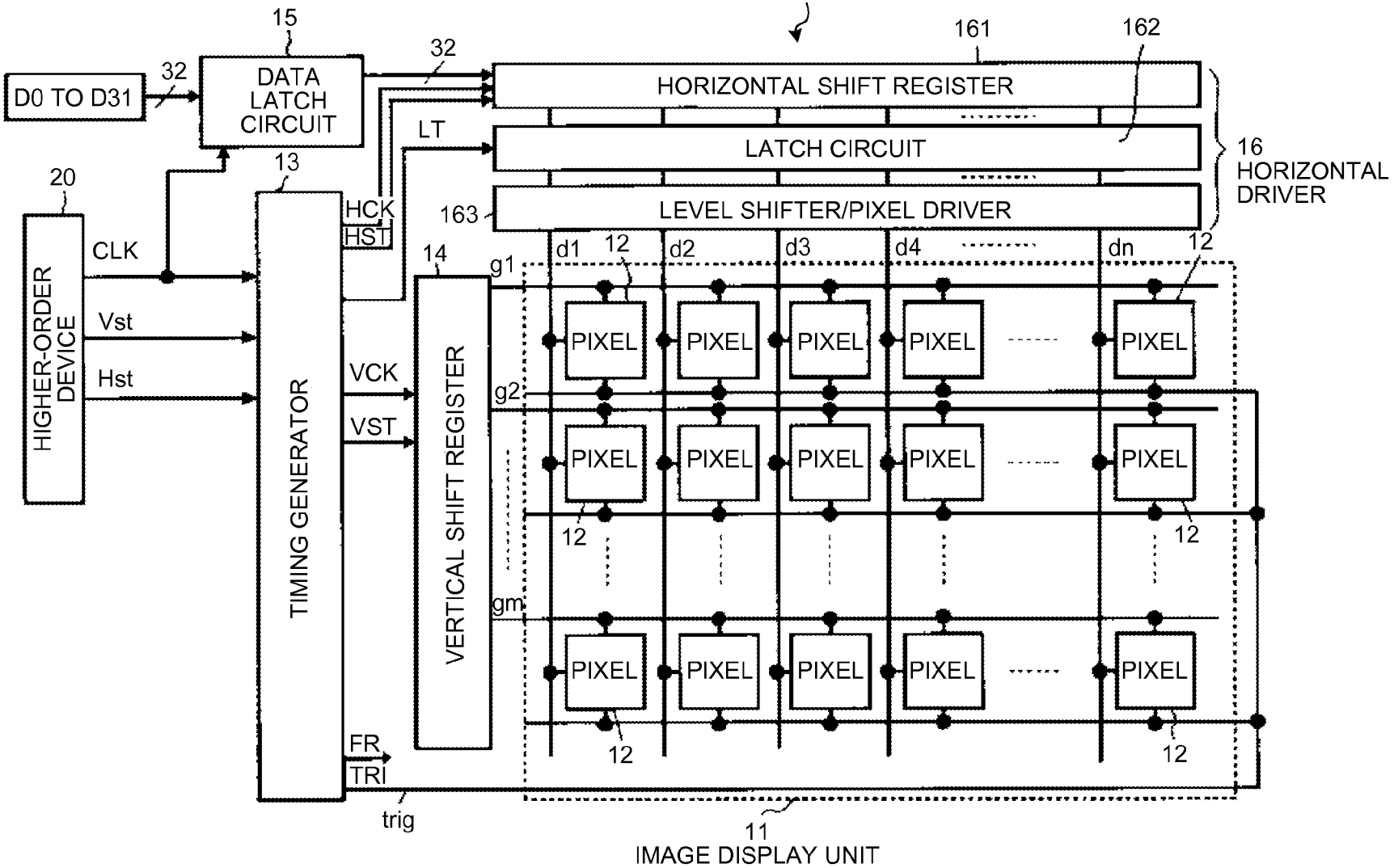
FIG. 1 is an overall configuration diagram of an embodiment of a liquid crystal display device.

Hereinafter, embodiments will be described with reference to the drawings. FIG. 1 is a block diagram of a liquid crystal display device 10 according to an embodiment.

The liquid crystal display device 10 is configured from an image display unit 11 in which a plurality of pixels 12 is regularly arranged, a timing generator 13, a vertical shift register 14, a data latch circuit 15, and a horizontal driver 16.

Further, the horizontal driver 16 is configured from a horizontal shift register 161, a latch circuit 162, and a level shifter/pixel driver 163.

The image display unit 11 is configured from a total of m×n pixels 12 arranged in a two-dimensional matrix manner, the pixels 12 being respectively arranged in intersection portions where m row scanning lines g1 to gm (m is an integer of 2 or more), one ends of which are connected to the vertical shift register 14, and extending in a row direction (X direction), and n column data lines d1 to dn (n is an integer of two or more), one ends of which are connected to a level shifter/pixel driver 163, and extending in the column direction (Y direction) (in FIG. 1, the image display unit is illustrated by a block surrounded by a broken line). A circuit configuration of the pixel 12 will be described below. One ends of all of the pixels 12 in the image display unit 11 are commonly connected to a trigger line trig connected to the timing generator 13.

Note that, in FIG. 1, the column data lines indicate n column data lines d1 to dn. However, there is a case where a total of n sets of column data lines may be used where a normal data column data line dj and an inverted data column data line dbj make a set. Normal data transmitted through the normal data column data line dj and inverted data transmitted through the inverted data column data line dbj are one-bit data always having a relation of an inverse logical value (a complementary relation).

Further, only one trigger line trig is illustrated in FIG. 1. However, there is a case of using two trigger lines made of a normal trigger pulse trigger line trig and an inverted trigger pulse trigger line trigb. A normal trigger pulse transmitted through the normal trigger pulse trigger line trig and an inverted trigger pulse transmitted through the inverted trigger pulse trigger line trigb are always in a relation of an inverse logical value (a complementary relation).

The timing generator 13 receives external signals such as a vertical synchronizing signal Vst, a horizontal synchronizing signal Hst, and a basic clock CLK from a higher-order device 20 as input signals. The timing generator 13 then generates various internal signals such as an alternating signal FR, a V start pulse VST, an H start pulse HST, a clock signal VCK, a clock signal HCK, a latch pulse LT, and a trigger pulse TRI based on the external signals.

Among the internal signals, the alternating signal FR is signal, the polarity of which is inverted in each one sub-frame. The alternating signal FR is supplied to a common electrode of a liquid crystal display element in the pixels 12 that configure the image display unit 11 as a common electrode voltage Vcom described below. Switching of the sub-frames is controlled by the start pulse VST.

The start pulse HST is a pulse signal output at a start timing to be input to the horizontal shift register 161. The clock signal VCK is a shift clock that defines one horizontal scanning period (1H) in the vertical shift register 14; and the vertical shift register performs a shift operation in accordance with a timing of the clock signal VCK. The clock signal HCK is a shift clock in the horizontal shift register 161, and is a signal for shifting data in a 32-bit width.

The latch pulse LT is a pulse signal that is output at a timing at which the horizontal shift register 161 completes shift of data of the number of pixels of one row in the horizontal direction. The trigger pulse TRI is a pulse signal supplied to all of the pixels 12 in the image display unit 11 through the trigger line trig. The trigger pulses TRI are sequentially output to a first signal holding unit (illustration is omitted in FIG. 1) provided in each pixel 12 in the image display unit 11 immediately after completion of writing of the data. Then, during the sub-frame period, the data in the first signal holding units of all of the pixels 12 in the image display unit 11 are transferred to second signal holding units (illustration is omitted in FIG. 1) of the same pixels 12 all at once. Note that the first and second signal holding units will be described in detail below.

The vertical shift register 14 transfers the V start pulse VST first supplied to each of the sub-frame according to the clock signal VCK. The vertical shift register then sequentially and exclusively supplies row scanning signals to the row scanning lines g1 to gm in units of 1H. Accordingly, the row scanning lines are sequentially selected one by one in units of 1H from the uppermost row scanning line g1 to the lowermost row scanning line gm in the image display unit 11.

The data latch circuit 15 latches the data having the 32-bit width supplied from an external circuit (not illustrated) and divided for each sub-frame based on the basic signal CLK from the higher-order device 20, and then outputs the data to the horizontal shift register 161 in synchronization with the basic signal CLK.

Here, in the present embodiment in which one frame of a video signal is divided into a plurality of sub-frames having a display period shorter than one frame period, and gradation display is performed by a combination of the sub-frames, gradation data that indicates a gradation of each pixel of the video signal is converted into one-bit sub-frame data in units of sub-frame for displaying the gradation of each pixel in the plurality of sub-frames as a whole in a higher-order configuration circuit outside the above-described pixels and peripheral circuits. Then, in the higher-order configuration circuit outside the pixels and the peripheral circuits, the sub-frame data of the 32 pixels in the same sub-frame are collectively supplied to the data latch circuit 15 as the 32-bit width data.

The horizontal shift register 161 starts shift by the H start pulse HST supplied from the timing generator 13 at the beginning of 1H when viewed in a processing system of one-bit serial data; and shifts the 32-bit width data supplied from the data latch circuit 15 in synchronization with the clock signal HCK. The latch circuit 162 latches n-bit data supplied from the horizontal shift register 161 in parallel (that is, sub-frame data of n pixels in the same row) according to a latch pulse LT supplied from the timing generator 13 at the timing when the horizontal shift register 161 has completed the shift of the n-bit data that is the same as the number of pixels n of one row of the image display unit 11, and outputs the data to a level shifter of the level shifter/pixel driver 163.

When the data transfer to the latch circuit 162 has been completed, the H start pulse is again output from the timing generator 13, and the horizontal shift register 161 resumes shift of the 32-bit width data from the data latch circuit 15 according to the clock signal HCK.

The level shifter provided in the level shifter/pixel driver 163 perform level shift of the signal level of n sub-frame data, corresponding to n pixels of one row latched by and supplied from the latch circuit 162, into a liquid crystal driving voltage. A pixel driver provided in the level shifter/pixel driver 163 outputs the n sub-frame data, corresponding to the n pixels of one row after the level shift, to the n data lines d1 to dn in parallel.

The horizontal shift register 161, the latch circuit 162, and the level shifter/pixel driver 163 that configure the horizontal driver 16 perform an output of data to a pixel row to which data is written in the 1H this time, and shift of data related to a pixel raw to which the data is to be written in the next 1H, in parallel. In a horizontal scanning period, n latched sub-fame data of one row are respectively output to the n data lines d1 to dn in parallel and all at once.

The n pixels 12 of one raw, selected by a row scanning signal from the vertical shift register 14 among the plurality of pixels 12 that configure the image display unit 11, sample the n sub-frame data of one raw output from the level shifter/pixel driver 163 all at once through the n data lines d1 to dn; and writes the data in the first signal holding units (illustration is omitted in FIG. 1) described below in the pixels 12.

Figure 2:
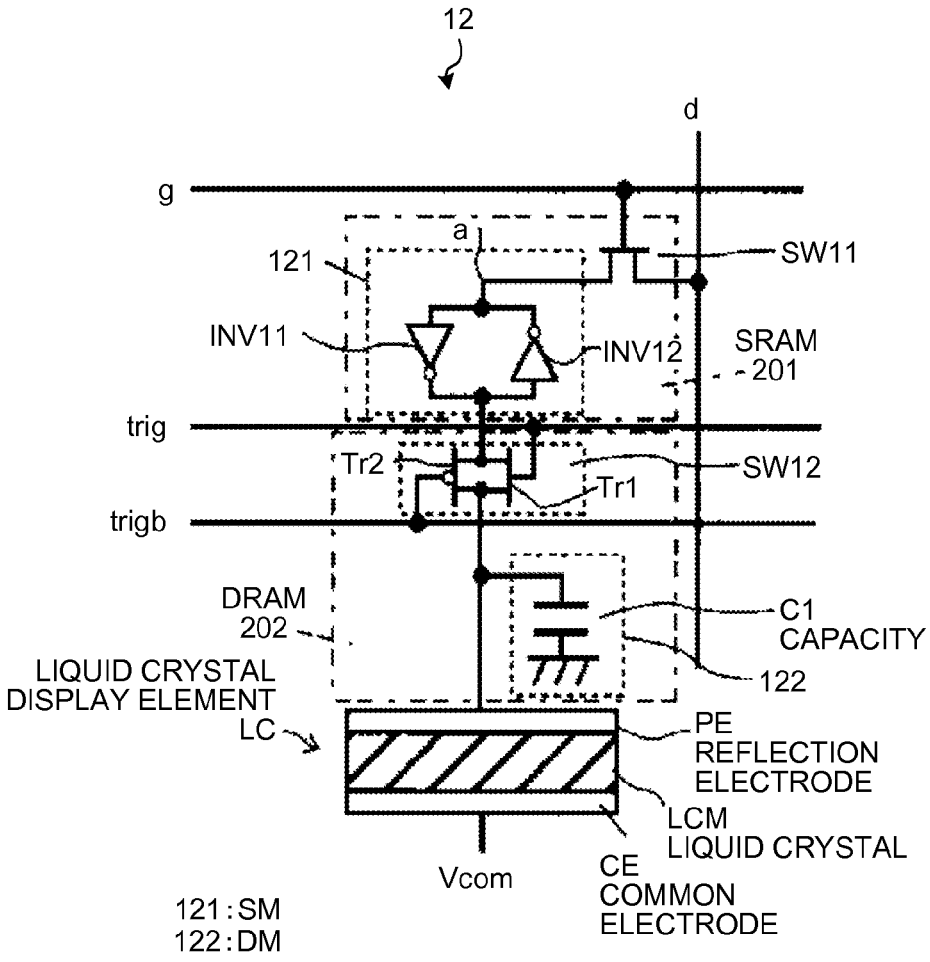
FIG. 2 is a circuit diagram of a first embodiment of a pixel that is a substantial part.

Next, embodiments of the pixel 12 of the liquid crystal display device 10 will be described in detail. FIG. 2 illustrates a circuit diagram of a first embodiment of a pixel that is a substantial part. In FIG. 2, a pixel 12A of the present embodiment is a pixel provided at an intersection portion of an arbitrary column data line d and an arbitrary row scanning line g of FIG. 1; and is configured from a static random access memory (SRAM) 201 configured from a switch SW11 that configures a first switching unit and a first signal holding unit (SM) 121, a dynamic random access memory (DRAM) 202 configured from a switch SW12 that configures a second switching unit and a second signal holding unit (DM) 122, and a liquid crystal display element LC. The liquid crystal display element LC is configured from a structure formed such that the liquid crystal LCM is filled and enclosed in a space between a reflection electrode PE and a common electrode CE that are separately arranged.

The switch SW11 is configured from an N-channel metal oxide semiconductor (MOS) type transistor (hereinafter, referred to as NMOS transistor) in which a gate is connected to the row scanning line g, a drain is connected to the column data line d, and a source is connected to an input terminal of the SM 121. The SM 121 is a self-holding type memory made of two inverters INV11 and INV12 in which an output terminal of one of them is connected to an input terminal of the another.

Figure 4:
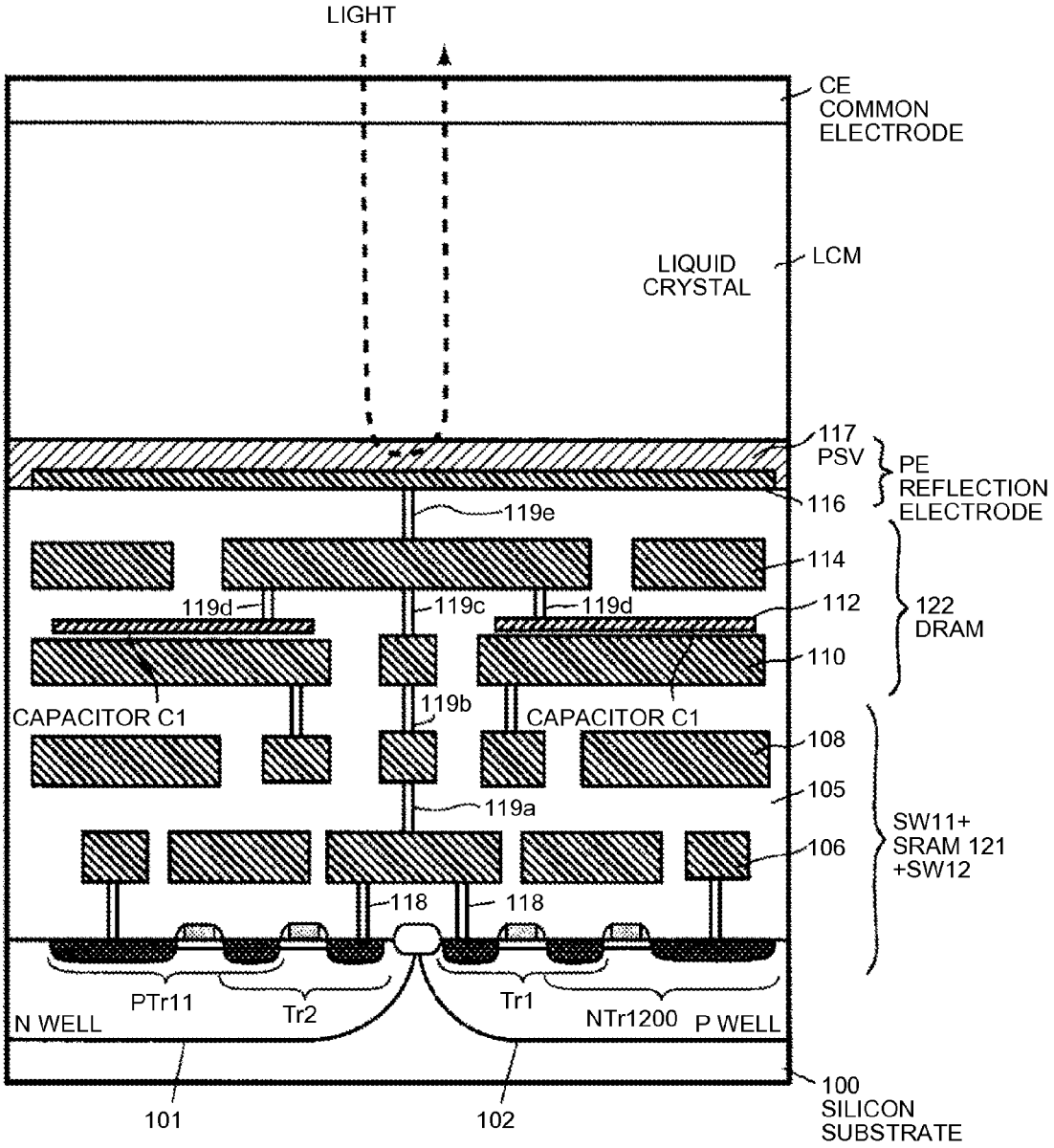
FIG. 4 is a cross-sectional configuration diagram of an example of one pixel illustrated in FIG. 2.

An input terminal of the inverter INV11 is connected to an output terminal of the inverter INV12 and the source of the NMOS transistor that configures the switch SW11. An input terminal of the inverter INV12 is connected to the switch SW12 and an output terminal of the inverter INV11. Both of the inverters INV11 and INV12 have a configuration of a CMOS inverter made of a P-channel MOS-type transistor (hereinafter, referred to as PMOS transistor) PTr and an NMOS transistor NTr in which mutual gates and drains are connected to each other as illustrated in FIG. 4; but the driving force of the inverters are different.

That is, a transistor of the input-side inverter INV11 that configures the SM 121 when viewed from the switch SW11 has larger driving force than a transistor of the output-side inverter INV12 that configures the SM 121 when viewed from the switch SW11. Further, the NMOS transistor that configures the switch SW11 has larger driving force than the NMOS transistor that configures the inverter INV12.

This is because, when data of the SM 121 is rewritten, especially, when an input-side voltage a of the switch SW11 of the SM 121 is an "L" level, and data transmitted through the column data line d is an "H" level, it is necessary to make the voltage a higher than an input voltage at which the inverter INV11 is inverted. The voltage a at the "H" level is determined by a ratio of a current of the NMOS transistor that configures the inverter INV12 and a current of the NMOS transistor that configures the switch SW11. At this time, the switch SW11 is an NMOS transistor, and thus, when the switch SW11 is ON, a VDD-side voltage of a power supply transmitted thereto through the column data line d is not input to the SM 121 due to a threshold voltage Vth of the transistor, and the voltage of the "H" level is lower than VDD by Vth. Moreover, with this voltage, the switch SW11 is driven at around Vth of the transistor, and thus the current hardly flows. That is, as the voltage a that conducts the switch SW11 becomes higher; the current flowing through the switch SW11 becomes less.

That is, it is necessary that the current flowing in the switch SW11 is larger than the current flowing in the NMOS transistor that configures the transistor of the output-side inverter INV12, in order for the voltage a to reach a voltage or more at which the input-side transistor of the inverter INV11 is inverted when the voltage a is the "H" level. Therefore, the driving force of the NMOS transistor that configures the switch SW11 is made larger than the driving force of the NMOS transistor that configures the inverter INV12, which needs to be taken into account when to determine the transistor size of the NMOS transistor that configures the switch SW11 and the transistor size of the NMOS transistor that configures the inverter INV12.

The switch SW12 is configured from a known transmission gate made of an NMOS transistor Tr1 and a PMOS transistor Tr2 in which mutual drains are connected, and mutual sources are connected. A gate of the NMOS transistor Tr1 is connected to the normal trigger pulse trigger line trig, and a gate of the PMOS transistor Tr2 is connected to the inverted trigger pulse trigger line trigb.

Further, one terminal of the switch SW12 is connected to the SM 121, and the another terminal is connected to the DM 122 and the reflection electrode PE of the liquid crystal display element LC. Therefore, the switch SW12 is turned ON when the normal trigger pulse supplied through the trigger line trig is the "H" level (at this time, the inverted trigger pulse supplied through the trigger line trigb is the "L" level), and reads out the stored data of the SM 121 to the DM 122 and the reflection electrode PE. Further, the switch SW12 is in an OFF state when the normal trigger pulse supplied through the trigger line trig is the "L" level (at this time, the inverted trigger pulse supplied through the trigger line trigb is the "H" level), and does not perform reading out the stored data of the SM 121.

The switch SW12 is configured from a known transmission gate made of an NMOS transistor Tr1 and a PMOS transistor Tr2, and thus can turn ON/OFF the voltage in a range from GND to VDD. That is, when a signal applied to each gate of the NMOS transistor Tr1 and the PMOS transistor Tr2 is the GND-side potential ("L" level), the NMOS transistor Tr1 can be conducted with low resistance while the PMOS transistor Tr2 cannot be conducted instead.

Meanwhile, when the gate input signal is the VDD-side potential ("H" level), the PMOS transistor Tr2 can be conducted with low resistance, while the NMOS transistor Tr1 cannot be conducted instead. Therefore, ON/OFF of the transmission gate that configures the switch SW12 is controlled by the normal trigger pulse supplied through the trigger line trig and the inverted trigger pulse supplied through the trigger line trigb, so that the voltage range from GND to VDD can be switched with low resistance/high resistance.

The DM 122 is configured from a capacitor C1. Here, when the stored data of the SM 121 and the held data of the DM 122 are different, the switch SW12 is ON, and when the stored data of the SM 121 is transferred to the DM 122, it is necessary to rewrite the held data of the DM 122 with the stored data of the SM 121.

When the held data of the capacitor C1 that configures the DM 122 is rewritten, the held data is changed by charging and discharging; and the charging/discharging of the capacitor C1 is driven by an output signal of the inverter INV11. When the held data of the capacitor C1 is rewritten from the "L" level to the "H" level by charging, the output signal of the inverter INV11 is "H", and the PMOS transistor that configures the INV11 (PTr of FIG. 3) is ON, and the NMOS transistor (NTr of FIG. 3) is OFF, and thus the capacitor C1 is charged by the power supply voltage VDD connected to the source of the PMOS transistor of the inverter INV11.

Meanwhile, when the held data of the capacitor C1 is rewritten from the "H" level to the "L" level by discharging, the output signal of the inverter INV11 is "L" level, and the NMOS transistor (NTr of FIG. 3) that configures the inverter INV11 at this time is ON, and the PMOS transistor (PTr of FIG. 3) is OFF, and thus accumulated charges of the capacitor C1 are discharged to the GND through the NMOS transistor (NTr of FIG. 3) of the inverter INV11. Since the switch SW12 has a configuration of an analog switch using the above-described transmission gate, high-speed charging/discharging of the capacitor C1 becomes possible.

Further, in the present embodiment, the driving force of the inverter INV11 is set larger than that of the inverter INV12, and thus charging/discharging of the capacitor C1 that configures the DM 122 can be driven at a high speed. Further, when the switch SW12 is turned ON, the charges stored in the capacitor C1 have an influence on the input gate of the inverter INV12. However, the driving force of the inverter INV11 is set larger than the inverter INV12, so that the charging/discharging of the capacitor C1 by the inverter INV11 is more preferentially performed than by the data input inversion of the inverter INV12, and that the stored data of the SM 121 are not written.

Note that the SRAM 201 and the DRAM 202 can be considered to respectively have two-stage DRAM configurations made of a capacitor and a switch. However, in this case, when the capacitor used in place of the SM 121 and the capacitor that configures the DM are conducted, neutralizing of the charges occurs and amplitude of the GND and VDD voltages cannot be obtained. In contrast, according to the pixel 12A illustrated in FIG. 2, one-bit data can be transferred from the SM 121 to the DM 122 with the amplitude of the GND and VDD voltages; and when the pixels 12A are driven by the same power supply voltage, the applied voltage of the liquid crystal display element LC can be set higher, and the dynamic range can be made large.

Further, it can be considered that the SRAM 201 is changed to have a configuration made of a capacitor and a switch, and the DRAM 202 is changed to an SRAM. However, in this case, there is a problem that the operation becomes unstable compared with the pixel 12A of the present embodiment of FIG. 2. That is, in the case of the above-configuration, it is necessary to rewrite the stored data of the SRAM used in place of the DM 122 with the charge stored in the capacitor used in place of the SM 121. Usually, the data holding capability of the memory by the SRAM is higher than the charge holding capability of the capacitor. Therefore, there is a possibility of occurrence of malfunction that the charges of the capacitor used in place of the SM 121 of the pre stage is written with the stored data of the SRAM used in place of the DM 122. Further, in this case, when the capacitor used in place of the SM 121 is caused not to be rewritten with the SRAM data of the post stage, the capacitor needs to be made large, and thus there are problems that a pixel pitch is increased and it is not suitable for downsizing of the pixel.

According to the pixel 12A of the present embodiment illustrated in FIG. 2, the applied voltage of the liquid crystal display element LC can be set larger as described above, and thus not only an effect that the dynamic range can be made large, but also an effect that the downsizing of the pixel becomes possible can be obtained. The downsizing of the pixel is realized by the reason that the SM 121, the DM 122, and the reflection electrode PE can be effectively arranged in a height direction of the elements as described below, in addition to the reason that, since the inverter INV11 and the inverter INV12 are respectively configured from two transistors as illustrated in FIG. 2, the pixel is configured from a total of seven transistors and one capacitor C1, and thus configured from a smaller number of configuration elements than a conventional pixel.

FIG. 4 is a cross-sectional configuration diagram of a pixel of the liquid crystal display device 10. As the capacitor C1 illustrated in FIG. 2, a metal-insulator-metal (MIM) capacitor that forms a capacitor between pieces of wiring, a diffusion capacitor that forms a capacitor between a substrate and a polysilicon, a poly-insulator-poly (PIP) capacitor that forms a capacitor between two-layer polysilicon, or the like. FIG. 4 illustrates a cross-sectional configuration diagram of the liquid crystal display device 10 in a case where the capacitor C1 is configured from an MIM.

In FIG. 4, the PMOS transistor PTr11 of the inverter INV11 and the PMOS transistor Tr2 of the switch SW12, drains of which are connected by commonly using a diffusion layer serving as the drains, are formed on an N well 101 formed on a silicon substrate 100. Further, the NMOS transistor NTr12 of the inverter INV12 and the NMOS transistor Tr1 of the switch SW12, drains of which are connected by commonly using a diffusion layer serving as the drains, are formed on a P well 102 formed on the silicon substrate 100. Note that, in FIG. 4, illustrations of the NMOS transistor that configures the inverter INV11 and the PMOS transistor that configures the inverter INV12 are omitted.

Further, above each of the transistors PIM, Tr2, Tr1, and NTr12, a first metal 106, a second metal 108, a third metal 110, an electrode 112, a fourth metal 114, and a fifth metal 116 are layered interposing an interlayer insulation film 105 between the metals. The fifth metal 116 configures the reflection electrode PE formed in each pixel. Each diffusion layer that configures each source of the NMOS transistor Tr1 and the PMOS transistor Tr2 that configure the switch SW12 is electrically connected to the first metal 106 by a contact 118, and is further electrically connected to a second metal 108, a third metal 110, a fourth metal 114, and a fifth metal 116 through through holes 119*a*, 119*b*, 119*c*, and 119*e*. That is, each source of the NMOS transistor Tr1 and the PMOS transistor Tr2 that configures the switch SW12 is electrically connected to the reflection electrode PE.

Further, a passivation film (PSV) 117 is formed on the reflection electrode PE (fifth metal 116) as a protection film, and is arranged separately facing the common electrode CE that is a transparent electrode. The liquid crystal LCM is filled and enclosed between the pixel electrode PE and the common electrode CE, and thus the liquid crystal display element LC is configured.

Here, the electrode 112 is formed on the third metal 110 through the interlayer insulation film 105. The electrode 112 configures the capacitor C1 together with the interlayer insulation film 105 which is between the third metal 110 and the third metal 110. When the capacitor C1 is configured from MIM, the SM 121, the switch SW11, and the switch SW12 can be formed by a transistor and wiring of each layer of the first metal 106 and the second metal 108; and the DM 122 can be formed by MIM wiring using the third metal 110 above the transistor. The electrode 112 is electrically connected to the fourth metal through the through hole 119*d*; and the fourth metal 114 is electrically connected to the reflection electrode PE through the through hole 119*e*, and thus the capacitor C1 is electrically connected to the reflection electrode PE.

Light from a light source (not illustrated) passes through the common electrode CE and the liquid crystal LCM and is incident on and is reflected at the reflection electrode PE (fifth metal 116); and reversely proceeds to the original incident path and is emitted through the common electrode CE.

According to the present embodiment, as illustrated in FIG. 4, the fifth metal 116 that is five-layer wiring is allocated to the reflection electrode PE, so that the SM 121, the DM 122, and the reflection electrode PE can be effectively arranged in the height direction; and the downsizing of the pixel can be realized. Accordingly, a pixel having a pitch of 3 μm or less can be configured from a transistor having the power supply voltage of 3.3 V. With the pixels having the pitch of 3 μm, a liquid crystal display panel having 0.55 inches in diagonal length, 4000 pixels in the lateral direction and 2000 pixels in the longitudinal direction can be realized.

Next an operation of the liquid crystal display device 10 of FIG. 1 using the pixels 12A of the present embodiment will be described with reference to the timing charts of FIG. 5.

As described above, in the liquid crystal display device 10 of FIG. 1, the row scanning lines are sequentially selected one by one from the row scanning line g1 to the row scanning line gm in units of 1H by a row scanning signal from the vertical shift register 14; and thus, in the plurality of pixels 12 (12A) that configures the image display unit 11, writing of data is performed in units of n pixels of one row commonly connected to a selected row scanning line. After the writing to all of the plurality of pixels 12 (12A) that configures the image display unit 11 has been completed, reading from all of the pixels is started all at once based on a trigger pulse.

Figure 5:
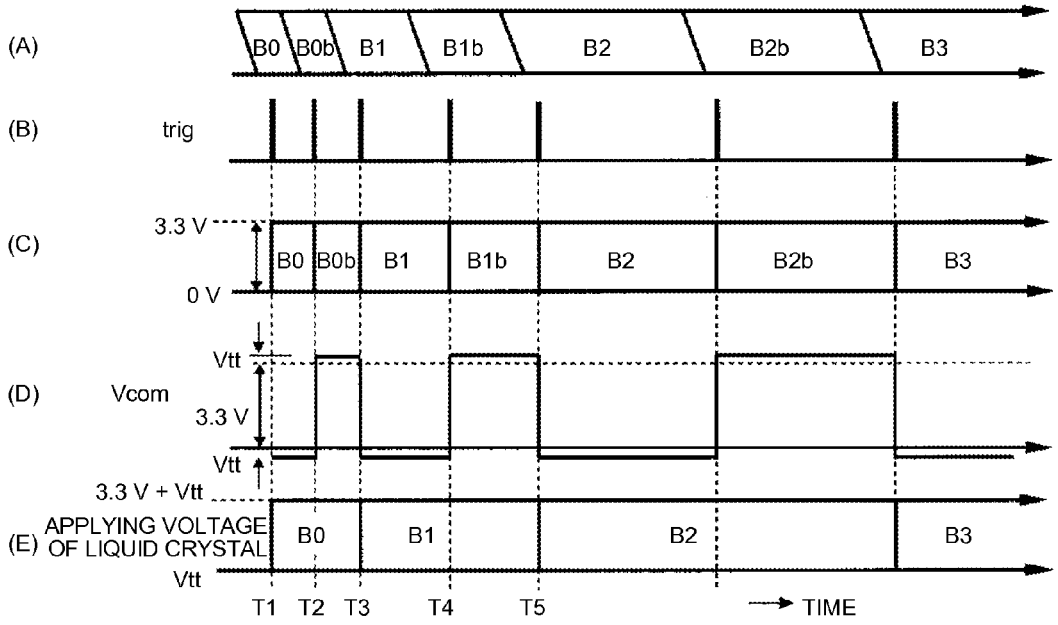
FIG. 5 is a timing chart for describing an operation of the pixel in the liquid crystal display device.

In FIG. 5, (A) schematically illustrates a writing period and a reading period of one pixel of one-bit sub-frame data output from the horizontal driver 16 to the column data lines d (d1 to dn). The diagonal line downward to the left indicates the writing period. Note that, in (A) of FIG. 5, B0*b*, B1*b*, and B2*b* are inverted data of bits B0, B1, and B2. Further, (B) in FIG. 5 illustrates a trigger pulse to be output from the timing generator 13 to the normal trigger pulse trigger line trig. The trigger pulse is output in every one sub-frame. Note that an inverted trigger pulse output to the inverted trigger pulse trigger line trigb has always an inverse logical value to a normal trigger pulse, and thus the illustration is omitted.

First, when the pixels 12A are selected by a row scanning signal, the switch SW11 is turned ON, at that time, normal sub-frame data of the bit B0 of (A) in FIG. 5 output to the column data line d is sampled by the switch SW11 and written in the SMs 121 of the pixels 12A. Hereinafter, similarly, the sub-frame data of the bit B0 is written to the SMs 121 of all of the pixels 12A that configure the image display unit 11, and at a timing T1 illustrated in FIG. 5 after the writing operation is completed, "H"-level normal trigger pulses are simultaneously supplied to all of the pixels 12A that configure the image display unit 11 as illustrated in (B) in FIG. 5.

Accordingly, the switches SW12 of all of the pixels 12A are turned ON, and thus the normal sub-frame data of the bit B0 stored in the SMs 121 are transferred and stored in the capacitors C1 that configure the DMs 122 through the switches SW12 all at once, and are applied to the reflection electrodes PE. A holding period of the normal sub-frame data of the bit B0 by the capacitor C1 is one sub-frame period from the time T1 to a time T2 at which a next "H"-level normal trigger pulse is input as illustrated at (B) in FIG. 5. (C) in FIG. 5 schematically illustrates bits of the sub-frame data applied to the reflection electrode PE.

Here, when the bit value of the sub-frame data is "1," that is, when the bit value is the "H" level, a power supply voltage VDD (here, 3.3 V) is applied to the reflection electrode PE; and when the bit value is "0," that is, when the bit value is the "L" level, 0 V is applied to the reflection electrode PE. Meanwhile, a free voltage can be applied to the common electrode CE of the liquid crystal display element LC as the common electrode voltage Vcom without being limited to GND and VDD, and the voltage is switched to a predetermined voltage at the same timing as a timing when the "H"-level normal trigger pulse is input. Here, the common electrode voltage Vcom is set lower by a threshold voltage Vtt of liquid crystal than 0 V as illustrated at (D) in FIG. 5 during a sub-frame period in which the normal sub-frame data is applied to the reflection electrode PE.

The liquid crystal display element LC performs gradation display according to an applied voltage of the liquid crystal LCM that is an absolute value of a difference voltage between an applied voltage of the reflection electrode PE and the common electrode voltage Vcom. Therefore, in one sub-frame period from a time T1 to a time T2 in which the normal sub-frame data of the bit B0 is applied to the reflection electrode PE, the applied voltage of the liquid crystal LCM is 3.3 V+Vtt (=3.3 V−(−Vtt)) when the bit value of the sub-frame data is "1"; and is +Vtt (=0 V−(−Vtt)) when the bit value of the sub-frame data is "0," as illustrated at (E) in FIG. 5.

Figure 6:
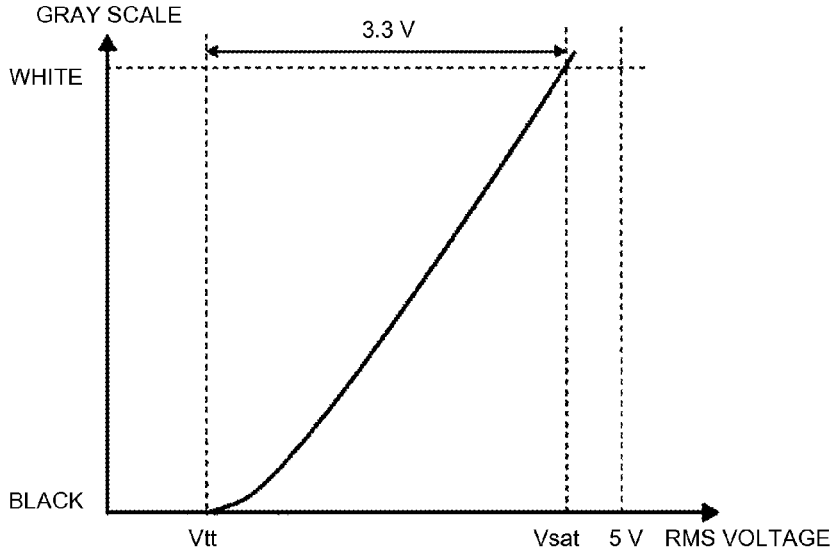
FIG. 6 is an explanatory diagram illustrating a saturation voltage of the liquid crystal display device and a threshold voltage of liquid crystal being multiplexed as binary-weighted pulse width modulation data.

FIG. 6 illustrates a relation between the applied voltage of the liquid crystal (RMS voltage) and a grayscale value of liquid crystal. As illustrated in FIG. 6, a black grayscale value of the grayscale value curve corresponds to the RMS voltage of the threshold voltage Vtt of the liquid crystal, and a white grayscale value is shifted to correspond to the RMS voltage of a saturation voltage Vsat (=3.3 V+Vtt) of the liquid crystal. The grayscale value can be caused to accord with an effective portion of a liquid crystal response curve. Therefore, the liquid crystal display element LC displays white when the applied voltage of the liquid crystal LCM is (3.3 V+Vtt), and displays black when the applied voltage is +Vtt.

Following that, in the sub-frame period in which the normal sub-frame data of the bit B0 is displayed, writing of the pixels 12A of inverted normal sub-frame data of the bit B0 to the SM 121 is sequentially started, as illustrated by B0*b* at (A) in FIG. 5. Then, when the inverted sub-frame data of the bit B0 has been written to the SMs 121 of all of the pixels 12A of the image display unit 11, and at the time T2 after completion of the writing, the "H"-level normal trigger pulses are simultaneously supplied to all of the pixels 12A that configure the image display unit 11 all at once, as illustrated at (B) in FIG. 5.

Accordingly, the switches SW12 of all of the pixels 12A are turned ON; and thus the inverted sub-frame data of the bit B0 stored in the SMs 121 are transferred and stored in the capacitors C1 that configure the DMs 122 through the switches SW12, and are applied to the reflection electrodes PE. A holding period of the inverted sub-frame data of the bit B0 by the capacitor C1 is one sub-frame period from the time T2 to a time T3 at which a next "H"-level normal trigger pulse is input as illustrated at (B) in FIG. 5. Here, the inverted sub-frame data of the bit B0 and the normal sub-frame data of the bit B0 are always in a relation of an inverse logical value; and thus, when the normal sub-frame data of the bit B0 is "1," the inverted sub-frame data is "0," and when the normal sub-frame data of the bit B0 is "0," the inverted sub-frame data is "1."

Meanwhile, the common electrode voltage Vcom is set higher by a threshold voltage Vtt than 3.3 V as illustrated in FIG. 5(D) during the sub-frame period in which the inverted sub-frame data is applied to the reflection electrode PE. Therefore, in the one sub-frame period from the time T2 to the time T3 in which the inverted sub-frame data of the bit B0 is applied to the reflection electrode PE, the applied voltage of the liquid crystal LCM is −Vtt (=3.3 V−(3.3 V+Vtt)) when the bit value of the sub-frame data is "1"; and is −3.3 V−Vtt (=0 V−(3.3 V+Vtt)) when the bit value of the sub-frame data is "0."

Therefore, when the bit value of the normal sub-frame data of the bit B0 is "1," the bit value of a subsequently input normal sub-frame data of the bit B0 is "0," and thus the applied voltage of the liquid crystal LCM is −(3.3 V+Vtt). The direction of a potential applied to the liquid crystal LCM becomes opposite to that of the normal sub-frame data of the bit B0, but the absolute value is the same. Therefore, the pixels 12A display white that is the same as the normal sub-frame data of the bit B0. Similarly, when the bit value of the normal sub-frame data of the bit B0 is "0," the bit value of a subsequently input normal sub-frame data of the bit B0 is "1," and thus, the applied voltage of the liquid crystal LCM is −Vtt. The direction of a potential applied to the liquid crystal LCM becomes opposite to that of the normal sub-frame data of the bit B0, but the absolute value is the same. Therefore, the pixels 12A display black.

Therefore, as illustrated at (E) in FIG. 5, the pixels 12A displays the same gradation in the bit B0 and a complementary bit B0*b* of the bit B0, and AC drive in which the potential direction of the liquid crystal LCM is inverted in every sub-frame is performed during the two sub-frame periods from the time T1 to the time T3. Therefore, burning of the liquid crystal LCM can be prevented.

Following that, during the sub-frame period in which the inverted sub-frame data of the complementary bit B0*b* is displayed, writing of the pixels 12A of the normal sub-frame data of the bit B1 to the SM 121 are sequentially started, as illustrated by B1 at (A) in FIG. 5. When the normal sub-frame data of the bit B1 is written in the SMs 121 of all of the pixels 12A of the image display unit 11, and at the time T3 after completion of the writing, the "H"-level normal trigger pulses are supplied to all of the pixels 12A that configure the image display unit 11, as illustrate at (B) in FIG. 5.

Accordingly, the switches SW12 of all of the pixels 12A are turned ON, and thus the normal sub-frame data of the bit B1 stored in the SMs 121 are transferred to the capacitors C1 that configure the DMs 122 through the switches SW12, and are applied to the reflection electrodes PE. A holding period of the normal sub-frame data of the bit B1 by the capacitor C1 is one sub-frame period from the time T3 to a time T4 at which a next "H"-level normal trigger pulse is input, as illustrated at (B) in FIG. 5.

Meanwhile, during the sub-frame period in which the normal sub-frame data is applied to the reflection electrode PE, the common electrode voltage Vcom is set lower by the threshold voltage Vtt of the liquid crystal than 0 V, as illustrated at (D) in FIG. 5. Therefore, during the one sub-frame period from the time T3 to the time T4 in which the normal sub-frame data of the bit B1 is applied to the reflection electrode PE, the applied voltage of the liquid crystal LCM is 3.3 V+Vtt (=3.3 V−(−Vtt)) when the bit value of the sub-frame data is "1"; and is +Vtt (=0 V−(−Vtt)) when the bit value of the sub-frame data is "0," as illustrated at (E) in FIG. 5.

Following that, during the sub-frame period in which the normal sub-frame data of the bit B1 is displayed, the pixels 12A of the inverted sub-frame data of the bit B1 to the SMs 121 are sequentially started, as illustrated by Bib at (A) in FIG. 5. Then, when the inverted sub-frame data of the bit B1 have been written to the SMs 121 of all of the pixels 12A of the image display unit 11, and at the time T4 after completion of the writing, the "H"-level normal trigger pulses are simultaneously supplied to all of the pixels 12A that configure the image display unit 11, as illustrated at (B) in FIG. 5.

Accordingly, the switches SW12 of all of the pixels 12A is turned ON; the inverted sub-frame data of the bit B1 stored in the SMs 121 are transferred and held in the capacitors C1 that configure the DMs 122 through the switches SW12, and are applied to the reflection electrodes PE. A holding period of the inverted sub-frame data of the bit B0 by the capacitor C1 is one sub-frame period from the time T4 to a time T5 at which a next "H"-level normal trigger pulse is input as illustrated at (B) in FIG. 5. Here, the inverted sub-frame data of the bit B1 and the normal sub-framed data of the bit B1 are in a relation of an inverse logical value.

Meanwhile, the common electrode voltage Vcom is set higher by the threshold voltage Vtt than 3.3 V as illustrated at (D) in FIG. 5 during the sub-frame period in which the inverted sub-frame data is applied to the reflection electrode PE. Therefore, during the one sub-frame period from the time T4 to the time T5 in which the inverted sub-frame data of the bit B1 is applied to the reflection electrode PE, the applied voltage of the liquid crystal LCM is −Vtt (=3.3 V−(3.3 V+Vtt)) when the bit value of the sub-frame data is "1,"; and is −3.3 V−Vtt (=0 V−(3.3 V+Vtt)) when the bit value of the sub-frame data is "0."

Therefore, as illustrated at (E) in FIG. 5, the pixels 12A displays the same gradation in the bit B1 and a complementary bit B1*b* of the bit B1, and AC drive, in which the potential direction of the liquid crystal LCM is inverted in every sub-frame, is performed during the two sub-frame periods from the time T3 to the time T5. Therefore, burning of the liquid crystal LCM can be prevented. Hereinafter, a similar operation is repeated, and according to the liquid crystal display device including the pixels 12A of the present embodiment, the gradation display can be performed by a combination of a plurality of dub-frames.

Note that the display periods of the bit B0 and the complementary bit B0*b* are the same first sub-frame period, and the display periods of the bit B1 and the complementary bit B1*b* are the same second sub-frame period. However, the first sub-frame period and the second sub-frame period are not necessarily the same. Here, as an example, the second sub-frame period is set twice the first sub-frame period. Further, as illustrated at (E) in FIG. 5, a third sub-frame period that is the display periods of the bit B2 and the complementary bit B2*b* is set twice the second sub-frame period. The same applies to other sub-frame periods, and each sub-frame period is determined to a predetermined length according to the system, and the number of sub-frames is determined to an arbitrary number.

Next, a method of not providing a complementary bit will be described. When a complementary bit for each bit is provided in order to prevent the burning of the liquid crystal LCM, it is necessary to display the same gradation (bit value) in the two sub-frame period. Therefore, compared with a case where a complementary bit is not provided, the number of possible combinations of the pulses becomes half, and the gradation display performance is reduced by half. Therefore, from the perspective of the gradation display performance, it is more advantageous not to provide a complementary bit.

Therefore, a method of preventing the burning of the liquid crystal LCM without providing a complementary bit will be described. Typically, the burning phenomenon is more likely to occur when a still image is continuously displayed. Therefore, when the image data, that is, the gradation of pixels is fixed between the frames, it is necessary to make a balance (DC balance) in the potential direction applied to the liquid crystal LCM symmetric, in other words, to make application times of a positive polarity voltage and a negative polarity voltage the same.

Figure 7:
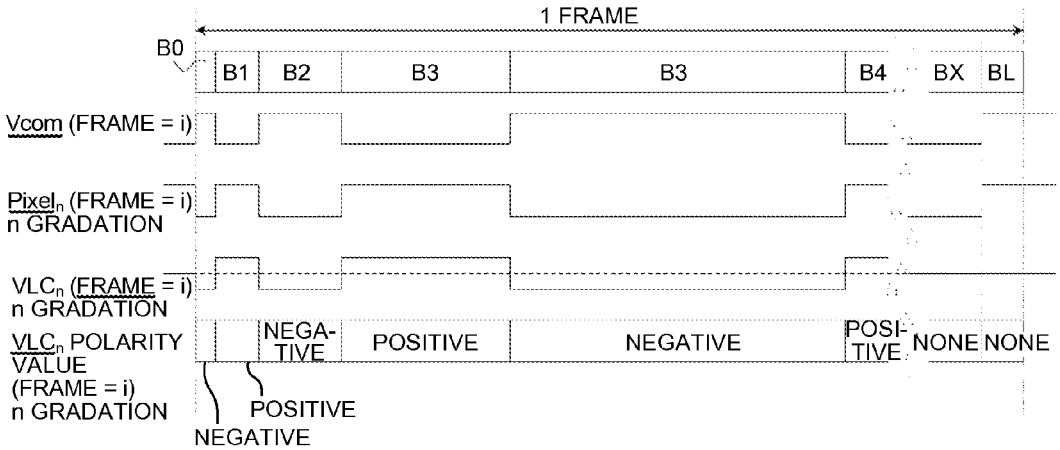
FIG. 7 is a timing chart of a pixel and a common electrode voltage in the liquid crystal display device in one frame period.

FIG. 7 illustrates polarity values of a common electrode voltage Vcom, a pixel electrode voltage Pixeln in an n gradation, a liquid crystal applied voltage VLCn in an n gradation, and a liquid crystal applied voltage VLCn in an arbitrary frame i (described as "1Frame" in FIG. 7) in a time axial direction. Further, the arbitrary frame i is divided into (X+1) sub-frames in the time axial direction, and periods of divided sub-frames are respectively B0 to BX. Further, a region corresponding to a vertical blanking period is BL.

Here, in a case of an n gradation pixel, the Pixeln is in ON state during a time corresponding to the n gradation, that is, a positive polarity voltage or a negative polarity voltage is applied. Here, a difference Tn in the potential direction of VLCn in one frame in the n gradation is expressed by the following expression (1). Note that the application time means an accumulation time within a frame.

$$Tn = \text{Positive polarity application time of } VLCn - \text{Negative polarity application time of } VLCn \quad (1)$$

Figure 8:
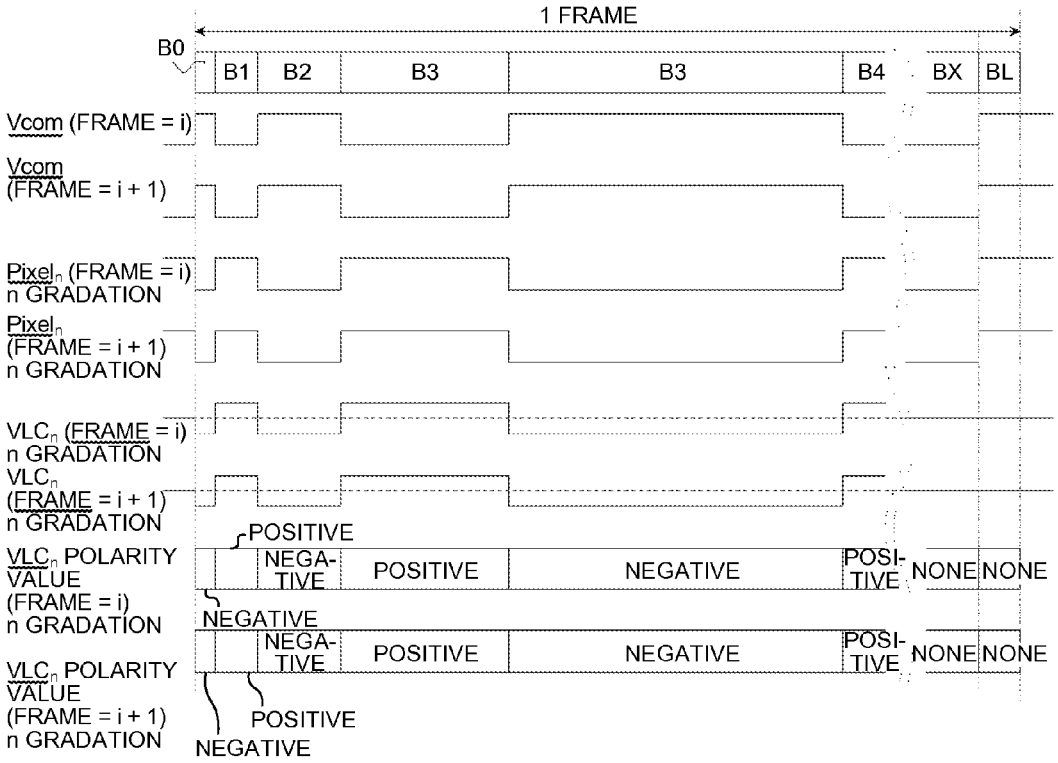
FIG. 8 is a timing chart of a pixel and a common electrode voltage in the liquid crystal display device in two frame periods.

Here, the difference of VLCn between an arbitrary frame i and an accumulation of the frame i and a next frame i+1 in the potential direction is 2Tn, as illustrated in FIGS. 8 and 10A. In this case, the balance of VLCn in the potential direction is shifted by Tn in each frame, and thus, there is a possibility that the burning phenomenon of the liquid crystal occurs.

Figure 9:
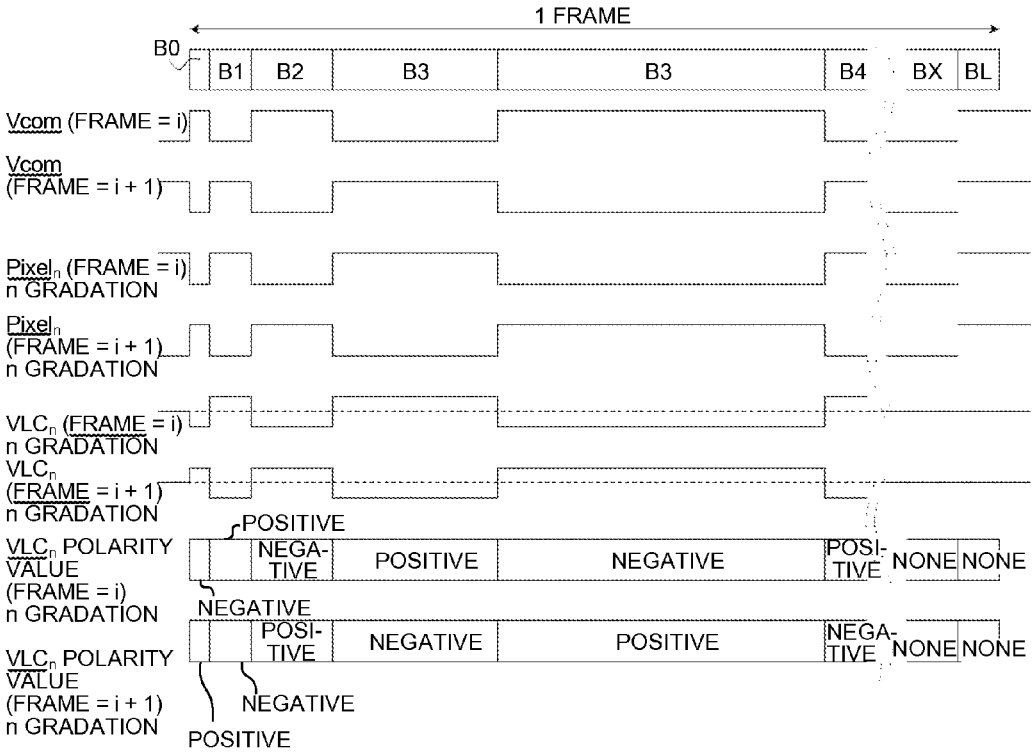
FIG. 9 is a timing chart of a pixel and a common electrode voltage in the liquid crystal display device in two frame periods.

Therefore, for example, a common voltage generation unit provided in the higher-order device 20 inverts the polarity of Vcom at the start of the frame, as illustrated in FIG. 9. Accordingly, the burning of the liquid crystal LCM can be prevented without providing a complementary bit. This is because, as illustrated in FIG. 9, the polarity value of VLCn is inverted in the frame i and in the next frame i+1 in each sub-frame, and thus the positive polarity voltage and the negative polarity voltage are applied by the same time, and the balance in the direction of potential applied to the liquid crystal LCM can be symmetric as a total of the two frames. Actually, as illustrated in FIG. 10B, the balance of VLCn in the potential direction is 0, and a perfect symmetric relation is established as the total of the two frames.

By the way, there is a liquid crystal display device in which the gradation of the pixels is not fixed between frames even in a still image as a result of application of digital signal processing such as dithering for high image quality. Taking the frame rate control (FRC) system as an example, as illustrated in FIG. 11, while the gradation of the pixels should be originally the n gradation, a combination of the n gradation and the n+1 gradation is performed between frames, so that the n gradation, (n+0.25 gradation), (n+0.5 gradation), (n+0.75 gradation), so that interpolated is between the n gradation and the n+1 gradation. Accordingly, as an integrated value visually recognized by the observer, four times higher gradation performance can be expressed.

Figure 12:
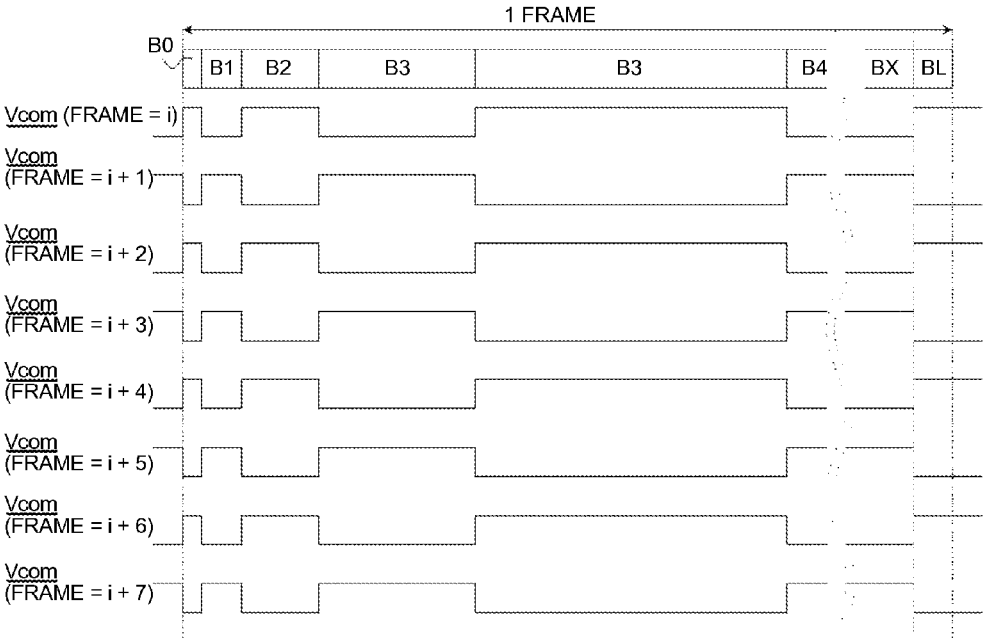
FIG. 12 is a timing chart of a pixel and a common electrode voltage in a case where the FRC signal processing is applied in the liquid crystal display device in eight frame periods.

In such a system, even in a still image, the gradation of the pixels, that is, Pixeln is changed between frames. Therefore, as illustrated in FIG. 12, only the inversion of the polarity of Vcom in each frame may cause the burning phenomenon. Actually, as illustrated in FIG. 14, in cases of the (n+0.25) gradation and the (n+0.75) gradation, the balance of VLCn in the potential direction is shifted by 2Tn+1−2Tn in each 8 frames, and thus, there is a possibility of occurrence of the burning phenomenon of the liquid crystal.

Figure 13:
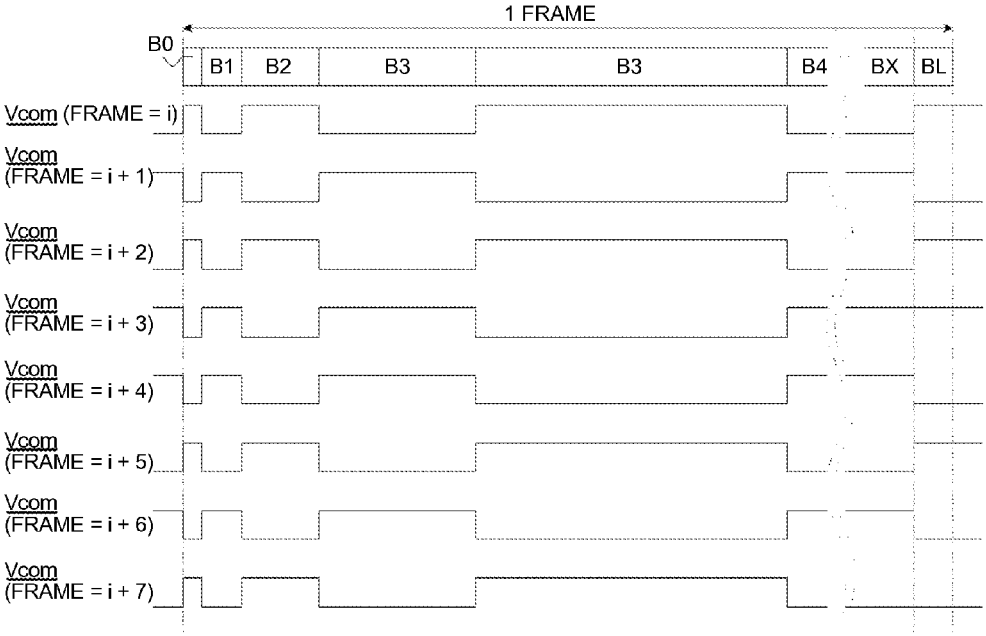
FIG. 13 is a timing chart of a pixel and a common electrode voltage in a case where the FRC signal processing is applied in the liquid crystal display device in eight frame periods.

Therefore, for example, taking an example of a case where a processing period of FRC is four frames as illustrated in FIGS. 13 and 15, the common voltage generation unit provided in the higher-order device 20 performs the inversion of the polarity of Vcom in the four frame periods in addition to performing of the inversion of the polarity of Vcom in each frame at the start of the frames, so that the balance in the direction of the potential applied to the liquid crystal LCM can be made symmetric as a total of eight frames. That is, in the frame i and the frame i+4, the frame i+1 and the frame i+5, the frame i+2 and the frame i+6, and the frame i+3 and the frame i+7, in each sub-frame, a positive polarity voltage and a negative polarity voltage are always applied for the same period of time.

Actually, as illustrated in FIG. 15, the balance of VLCn in the potential direction is 0, and a perfect symmetric relation is established in a total of the eight frames. As described above, the inversion of the polarity of Vcom is performed in the signal processing period in the frame direction, so that the burning of the liquid crystal LCM can be prevented even if the digital signal processing such as dithering is applied.

Figure 16:
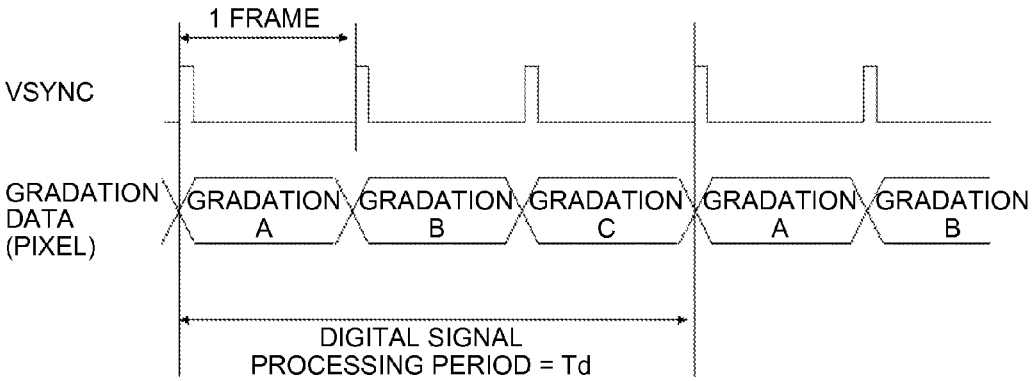
FIG. 16 is a timing chart describing digital signal processing in the liquid crystal display device.

Here, while the four-frame FRC processing period has been described as an example, the embodiment is not limited to the example; and any signal processing/period can be employed as long as the inversion of the polarity of Vcom is realized in the digital signal processing period in the frame direction. That is, as illustrated in FIG. 16, any digital signal processing can be employed as long as, in a case of displaying a still image, the gradation of the pixels is changed in units of one frame, and the gradation change is a predetermined signal processing pattern of a gradation A, a gradation B, a gradation C, a gradation A, a gradation B . . . with a predetermined signal processing period Td (in FIG. 16, Td=3 frames).

Next, a configuration of a pixel according to another embodiment will be described. The pixel 12A of the first embodiment realizes downsizing of the pixel and the like such that the first signal holding unit that samples and stores the sub-frame data supplied through the column data line d is the SM 121 configured from the SRAM 201; and the second signal holding unit that holds the sub-frame data supplied from the first signal holding unit for a predetermined period and applies the data to the reflection electrode is the DM 122 configured from the DRAM 202. In contrast, in second and third embodiments of pixels described below, both of first and second holding units employ SRAMS, similarly to the pixels described in Japanese Translation of PCT International Application Publication No. JP-T-JP 2001-523847 above. Note that, in the second and third embodiments of the pixels of substantial parts, the SRAMS have a predetermined configuration, so that stability of operations is realized, compared with the pixels described in Japanese Translation of PCT International Application Publication No. JP-T-JP 2001-523847.

Figure 17:
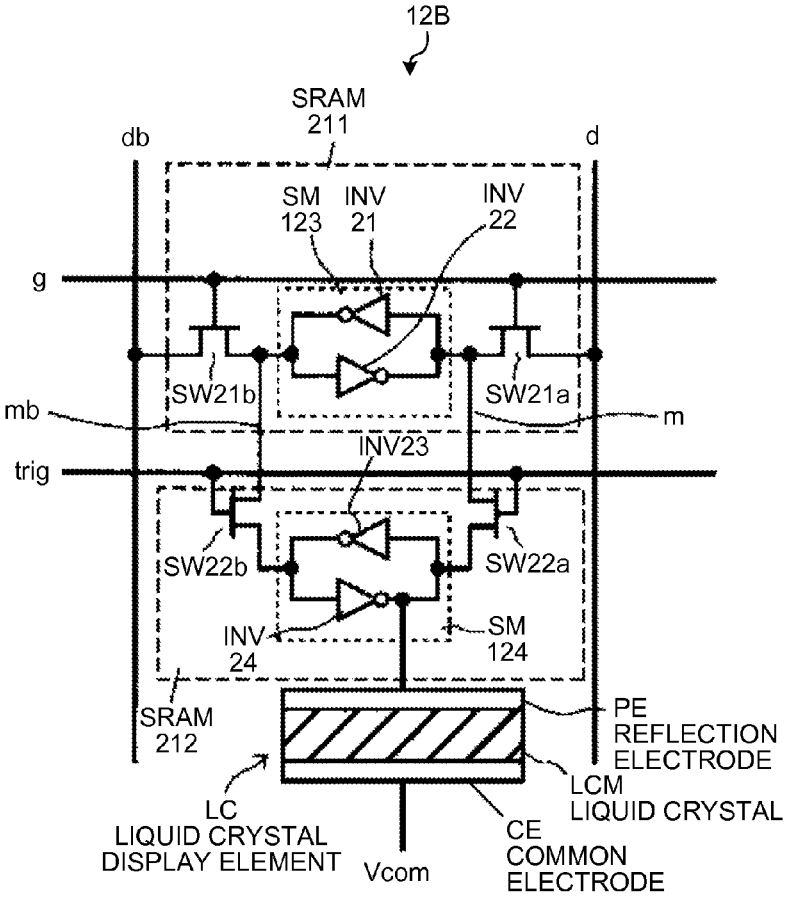
FIG. 17 is a circuit diagram of a second embodiment of a pixel that is a substantial part.

FIG. 17 illustrates a circuit diagram of a second embodiment of a pixel that is a substantial element of a liquid crystal display device. In the drawing, portions having the same configurations as FIG. 2 are denoted with the same reference signs, and description thereof is omitted. In FIG. 17, a pixel 12B of the second embodiment is a pixel provided at an intersection portion of an arbitrary set of normal data column data line d and an inverted data column data line db from among a total of n sets of column data lines in which a normal data column data line dj and an inverted data column data line dbj, one ends of which are connected to a level shifter/pixel driver 163 of FIG. 1 and extending in a column direction (Y direction), and an arbitrary row scanning line g, one end of which is connected to a vertical shift register 14, and extending in a row direction (X direction). Here, a normal data column data line dj and an inverted data column data line dbj make a set. The pixel 12B is configured from a first static random access memory (SRAM) 211, a second static random access memory (SRAM) 212, and a liquid crystal display element LC. The first SRAM 211 is configured from switches SW21*a* and SW21*b* that configure first and second switching units, and a first signal holding unit (SM) 123. Further, the second SRAM 212 is configured from switches SW22*a* and SW22*b* that configure third and fourth switching units, and a second signal holding unit (SM) 124.

The switch SW21*a* is configured from an NMOS transistor in which a gate is connected to the row scanning line g, a drain is connected to the column data line d, and a source is connected to one of input terminals of the SM 123. The switch SW21*b* is configured from an NMOS transistor in which a gate is connected to the row scanning line g, a drain is connected to the column data line db, and a source is connected to the another of the input terminals of the SM 123.

Figure 3:
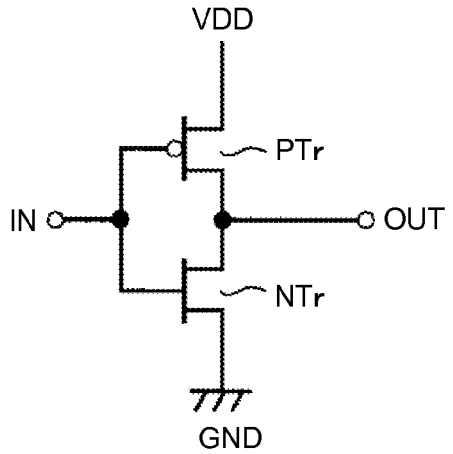
FIG. 3 is a circuit diagram of an example of an inverter.

The SM 123 is a self-holding type memory made of two inverters INV21 and INV22 in which an output terminal of one of them is connected to an input terminal of the other. An input terminal of the inverter INV21 is connected to an output terminal of the inverter INV22 and the source of the NMOS transistor that configures the SW21*a* and the switch SW22*a*. An input terminal of the inverter INV22 is connected to the source of the NMOS transistor that configures the SW21*b*, and the switch SW22*b*. Both of the inverters INV21 and INV22 have a configuration of a known CMOS inverter, as illustrated in FIG. 3.

Further, the switch SW22*a* is configured from an NMOS transistor in which a gate is connected to the trigger line trig, a drain is connected to a connection point of the SM 123 and the switch SW21*a*, and a source is connected to one of input terminals of the SM 124. The switch SW22*b* is configured from an NMOS transistor in which a gate is connected to the trigger line trig, a drain is connected to a connection point of the SM 123 and the switch SW21*b*, and a source is connected to the other of the input terminals of the SM 124.

The SM 124 is a self-holding type memory made of two inverters INV23 and INV24 in which an output terminal of one of them is connected to an input terminal of the other. An input terminal of the inverter INV23 is connected to an output terminal of the inverter INV24, the source of the NMOS transistor that configures the switch SW22*a*, and a reflection electrode PE. An input terminal of the inverter INV24 is connected to an output terminal of the inverter INV23, and the source of the NMOS transistor that configures the SW22*b*. Both of the inverters INV23 and INV24 have a configuration of a known CMOS inverter as illustrated in FIG. 3, similarly to the inverters INV21 and INV22.

The pixels 12B of the present embodiment perform a similar operation to the operation described with reference to the timing charts of FIG. 5. When the pixel 12B are selected by a row scanning signal, the switches SW21*a* and SW21*b* are turned ON. One-bit normal sub-frame data and one-bit inverted sub-frame data having mutually inverse logical values are supplied to the switches SW21*a* and SW21*b* through the column data line d and the column data line db. Here, the switches SW21*a* and SW21*b* are configured from an NMOS transistor, and when the normal sub-frame data and the inverted sub-frame data have the VDD-side voltage ("H"), the voltage is not input due to the threshold voltage Vth of the NMOS transistor; and only a voltage lower than VDD by Vth is input. Moreover, the current hardly flows with the voltage. Therefore, the normal sub-frame data or the inverted sub-frame data having a GND potential ("L") and sampled by the switch SW21*a* or SW21*b* is written in the SM 123.

Data writing to the SM 124 is performed through the switches SW22*a* and SW22*b* controlled by a trigger pulse supplied through the trigger line trig. Data supplied to the switch SW22*a* through wiring m from the connection point of the SM 123 and the switch SW21*a*, and data supplied from the connection point of the SM 123 and the switch SW21*b* to the switch SW22*b* through wiring mb are in a relation of an inverse logical value. Here, the switches SW22*a* and SW22*b* are configured from an NMOS transistor; and the VDD-side voltage ("H" level) is not input due to Vth of the NMOS transistor, and only a voltage lower than VDD by Vth is input. Moreover, with the voltage, the switches SW22*a* and SW22*b* are driven at around Vth of the NMOS transistor, and thus the current hardly flows. Therefore, data of the wiring m or the wiring mb having the GND potential ("L" level) is written in the SM 124.

Here, it is necessary to rewrite the data of the SM 124 with the stored data of SM 123, when the "H"-level trigger pulses are input through the trigger line trig immediately after the sub-frame data have been written to the SMs 123 of all of the pixels 12B that configure the image display unit 11. That is, the data of the SM 123 should not be rewritten with the data stored in the SM 124. Therefore, it is necessary that the driving force of the inverter that configures the SM 124 is made smaller than the driving force of the inverter that configures the SM 123. That is, when the stored data of the SM 123 and the SM 124 are different, the output data of the inverter INV21 and the output data of the inverter INV23 collide with each other at the timing when the "H"-level trigger pulse is input. Therefore, it is necessary to make the driving force of the inverter INV21 larger than the driving force of the inverter INV23 so that the data of the inverter INV24 is reliably rewritten with the output data of the inverter INV21. Further, with respect to the relation between the inverter INV22 and the inverter INV24, it is necessary to make the driving force of the inverter INV22 larger than the driving force of the inverter INV24 so that the output data of the inverter INV23 is reliably rewritten with the output data of the inverter INV22.

Figure 18:
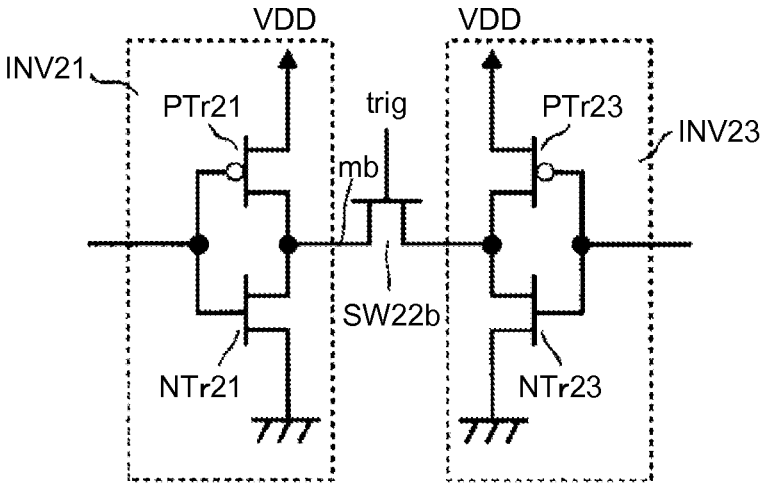
FIG. 18 is a diagram describing a magnitude relation of driving force of inverters that configure two SRAMs of FIG. 7.

The above matter will be further described with reference to FIG. 18. Briefly describing the relation between the inverter INV21 and the inverter INV23, when the output data of the SM 123 in the wiring mb is the "H" level, the PMOS transistor PTr21 that configures the inverter INV21 is in an ON state. In contrast, when the output data of the SM 124 on the wiring mb side has already been in the "L" level, the NMOS transistor NTr23 that configures the inverter INV23 is in an ON state.

At this time, when the NMOS transistor that configures the switch SW22*b* is turned ON by the "H"-level trigger pulse of the trigger pulse line trig, and the outputs of the inverter INV21 and the inverter INV23 are mutually conducted, the current flows from VDD to GND through the PMOS transistor PTr21 of the inverter INV21 and the NMOS transistor NTr23 of the inverter INV23. At this time, the voltage of the wiring mb is determined by a ratio between ON resistance of the PMOS transistor PTr21 and ON resistance of the NMOS transistor NTr23.

Contrary to that, when the output data of the SM 123 in the wiring mb is the "L" level, and the output data of the SM 124 on the wiring mb side has already been in the "H" level, and when the NMOS transistor that configures the switch SW22*b* is turned ON by the "H" level trigger pulse of the trigger pulse line trig, and the outputs of the inverter INV21 and the inverter INV23 are conducted with each other, the current flows from VDD to GND through the PMOS transistor PTr23 of the inverter INV23 and the NMOS transistor NTr21 of the inverter INV21. At this time, the voltage of the wiring mb is determined by a ratio between ON resistance of the PMOS transistor PTr23 and ON resistance of the NMOS transistor NTr21.

Further, an input gate (not illustrated) of the inverter INV24 is connected to the wiring mb, and the output data of the inverter INV24 is determined to the "L" level or the "H" level depending on an input of the voltage level of the wiring mb. That is, the output data of the SM 124 is determined according to the voltage level of the wiring mb. Therefore, to rewrite the data of the SM 124, it is necessary that the ON resistance of the transistors of the inverter INV21 and the inverter INV22 is lower than the ON resistance of the transistors of the inverter INV23 and the inverter INV24. When the ON resistance of the transistors of the inverter INV21 and the inverter INV22 are lower, the data of the SM 124 can be reliably rewritten with the output data of the SM 123 without depending on the data level of the SM 124.

Use of the transistor having low ON resistance can be realized by use of a transistor having large driving force, and can be realized by a decrease in the gate length or an increase in the gate width.

When one-bit data stored in the SMs 123 are written into the SMs 124 of all of the pixels 12B all at once, the trigger pulse of the trigger pulse line trig becomes the "L" level, and the switches SW22*a* and SW22*b* are turned OFF. Therefore, the SMs 124 hold the one-bit data, and the potential of the reflection electrode PE can be fixed to a potential according to the held data during an arbitrary time (here, during one sub-frame period).

The data written in the SMs 124 are the normal data and the inverted data switched in every one sub-frame illustrated at (C) in FIG. 5. Meanwhile, the common electrode potential Vcom is alternately switched to a predetermined potential in every one sub-frame in synchronization with the above writing, as illustrated at (D) in FIG. 5. According to the liquid crystal display device using the pixels 12B of the present embodiment, the AC drive in which the potential direction is inverted in every sub-frame is performed, similarly to the liquid crystal display device using the pixels 12A of the first embodiment. Therefore, display, in which the burning of the liquid crystal LCM is prevented, can be performed. Further, according to the liquid crystal display device using the pixels 12B of the present embodiment, the driving force of the inverters INV21 and INV22 that configure the SM 123, the driving force of the inverters INV23 and INV24 that configure the SM 124, and the driving force of each transistor that configures the switch SW21*a*, SW21*b*, SW22*a*, or SW22*b* are set to have the predetermined relation. Therefore, stable and accurate gradation display can be performed.

Note that the switches SW21*a*, SW21*b*, SW22*a*, and SW22*b* may be configured from a PMOS transistor, and opposite polarities to the above description may just be considered, and thus description thereabout is omitted.

Figure 19:
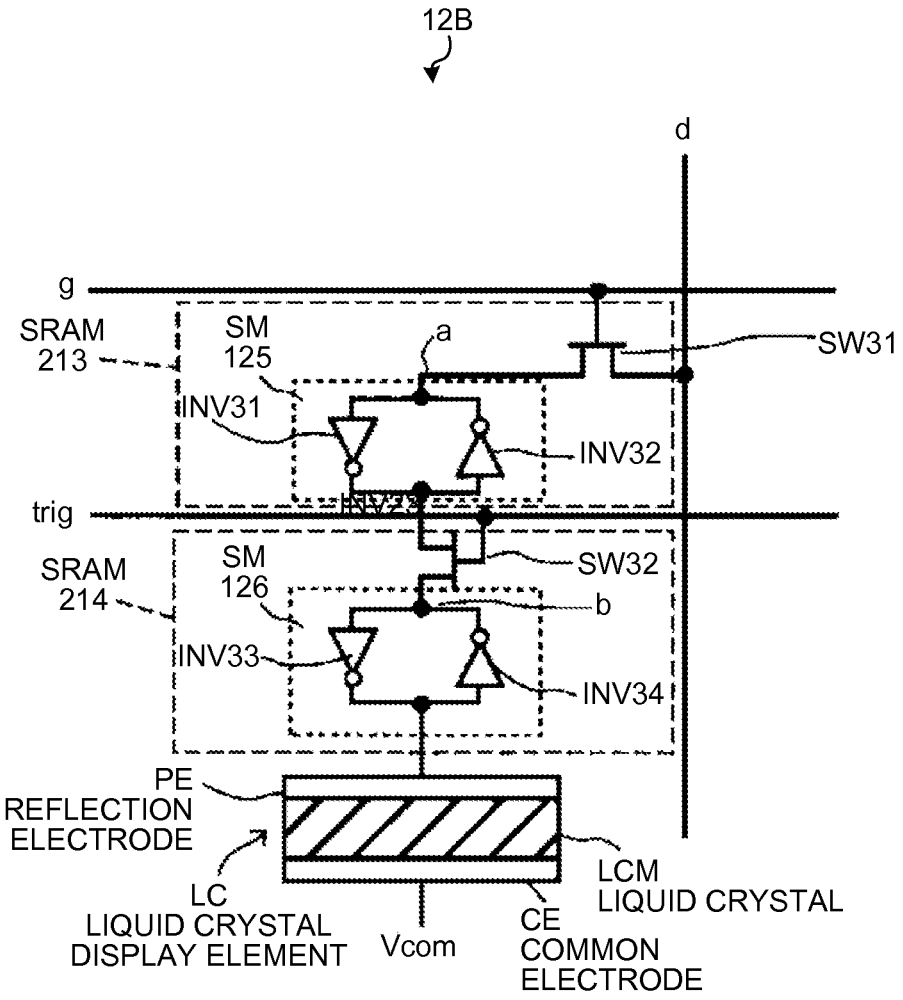
FIG. 19 is a circuit diagram of a third embodiment of a pixel that is a substantial part.

Next, a third embodiment of a pixel that is a substantial part of a liquid crystal display device will be described. FIG. 19 illustrates a circuit diagram of the third embodiment of a pixel that is a substantial part of a liquid crystal display device. In the drawing, portions having the same configurations as FIG. 7 are denoted with the same reference signs, and description thereof is omitted.

In FIG. 19, a pixel 12C of the third embodiment is a pixel provided at an intersection portion of an arbitrary column data line d from among column data lines d1 to dn, one ends of which are connected to a level shifter/pixel driver 163 of FIG. 1, and extending in a column direction (Y direction); and an arbitrary row scanning line g, one end of which is connected to a vertical shift register 14, and extending in a row direction (X direction). The pixel 12C is configured from a first static random access memory (SRAM) 213, a second static random access memory (SRAM) 214, and a liquid crystal display element LC. The first SRAM 213 is configured from a switch SW31 that configures a first switching unit, and a first signal holding unit (SM) 125. Further, the second SRAM 214 is configured from a switch SW32 that configures a second switching unit and a second signal holding unit (SM) 126. The pixels 12C of the present embodiment is configured from a two-stage SRAM, similarly to the pixels 12B described above. However, there is a characteristic in that writing to the SM 125 in the SRAM 213 and writing to the SM 126 in the SRAM 214 are respectively performed by one switch SW31 and switch SW32.

The switch SW31 is configured from an NMOS transistor in which a gate is connected to a row scanning line g, a drain is connected to a column data line d, and a source is connected to one of input terminals of the SM 125. The SM 125 is a self-holding type memory made of two inverters INV31 and INV32 in which an output terminal of one of them is connected to an input terminal of the other. An input terminal of the inverter INV31 is connected to an output terminal of the inverter INV32 and a source of an NMOS transistor that configures the SW31. An input terminal of the inverter INV32 is connected to an output terminal of the inverter INV31 and a drain of an NMOS transistor that configures the SW32. Both of the inverters INV31 and INV32 have a configuration of a CMOS inverter as illustrated in FIG. 3.

Further, the switch SW32 is configured from an NMOS transistor in which a gate is connected to a trigger line trig, a drain is connected to an output terminal of the SM 125, and a source is connected to an input terminal of the SM 126. The SM 126 is a self-holding type memory made of two inverters INV33 and INV34 in which an output terminal of one of them is connected to an input terminal of the other. An input terminal of the inverter INV33 is connected to an output terminal of the inverter INV34 and the reflection electrode PE. An input terminal of the inverter INV34 is connected to an output terminal of the inverter INV33 and a source of the NMOS transistor that configures the SW32. The inverters INV33 and INV34 have a known CMOS inverter as illustrated in FIG. 3, similarly to the inverters INV31 and INV32.

The pixel 12C of the present embodiment performs an operation similar to the operation described with reference to the timing charts of FIG. 5. When the pixels 12C are selected by a row scanning signal, the switch SW31 is turned ON, and at that time normal sub-frame data output to the column data line d is sampled by the switch SW31 and written in the SMs 125 of the pixels 12C. Hereinafter, similarly, normal sub-frame data is written to the SMs 121 of all of the pixels 12C that configure an image display unit 11; and after the writing operation is completed, "H"-level trigger pulses are simultaneously supplied to all of the pixels 12C that configure the image display unit 11. Accordingly, the switches SW32 of all of the pixels 12C are turned ON, and thus the normal sub-frame data stored in the SMs 125 are transferred and stored in the SRAMs 126 through the switches SW32 all at once, and are applied to the reflection electrodes PE. A holding period of the normal sub-frame data of the SM 126 is one sub-frame period until a next "H"-level trigger pulse is input to the trigger line trig.

Following that, each of the pixels 12C in the image display unit 11 is selected by a row scanning single in units of rows, similarly to the above description, and immediately preceding normal sub-frame data and inverted sub-frame data having an inverse logical value are written in the SM 125 for each pixel. When the writing of the inverted sub-frame data to the SMs 125 of all of the pixels 12C that configure the image display unit 11 has been completed, the "H"-level trigger pulses are simultaneously supplied to all of the pixels 12C that configure the image display unit 11. Accordingly, the switches SW32 of all of the pixels 12C are turned ON, and thus the inverted sub-frame data stored in the SMs 125 are transferred and stored in the SRAMs 126 through the switches SW32 all at once, and are applied to the reflection electrodes PE. A holding period of the inverted sub-frame data of the SM 126 is one sub-frame period until a next "H"-level trigger pulse is input to the trigger line trig.

Data writing to the SM 125 is performed through input from the one switch SW31 as described above. In this case, the transistor in the input-side inverter INV31 that configures the SM 125 when viewed from the switch SW31 has larger driving force than the transistor of the output-side inverter INV32 that configures the SM 125 when viewed from the switch SW31. Further, the NMOS transistor that configures the switch SW31 is configured of a transistor having larger driving force than the NMOS transistor that configures the inverter INV32. This is because a similar reason to the relation of the driving force between the inverters INV121 and INV122 and the switch SW11 of the pixels 12A described above, and thus description thereabout is omitted.

Further, data writing to the SM 126 is performed through the single switch SW32. In this case, the transistor in the input-side inverter INV33 that configures the SM 126 when viewed from the switch SW32 uses a transistor having larger driving force than the transistor of the output-side inverter INV34 that configures the SM 126 when viewed from the switch SW32.

Accordingly, when the trigger pulse becomes the "H" level and the switch SW32 is turned ON, and the stored data of the SM 125 and the SM 126 are different, the output data of the inverter INV31 and the output data of the inverter INV34 collide with each other. However, the driving force of the inverter INV31 is larger than that of the inverter INV34, and thus, the data of the SM 125 is not rewritten with the data of the SM 126, and the data of the SM 126 can be written with the data of the SM 125.

Further, the NMOS transistor that configures the switch SW32 is configured from a transistor having larger driving force than the NMOS transistor that configures the inverter INV34. This is because, in a case where the data of the SM 126 is rewritten, especially when an input-side voltage b of the SM 126 on the switch SW32 side is the "L" level, and the data of the SM 125 is the "H" level, it is necessary to make the voltage b higher than a threshold voltage at which the inverter INV33 is inverted.

That is, the voltage b is determined by a ratio between the current of the NMOS transistor that configures the inverter INV34 and the current of the switch SW32. At this time, since the switch SW32 is an NMOS transistor, the VDD-side voltage is not input due to the threshold Vth of the NMOS transistor, and the "H"-level voltage is lower than VDD by Vth. Moreover, with the voltage, the switch SW32 is driven at around Vth of the NMOS transistor, and thus the current hardly flows. That is, as the voltage b that conducts the switch SW32 becomes higher, the current flowing through the switch SW32 becomes less. That is, it is necessary that the current flowing in the switch SW32 is larger than the current flowing in the NMOS transistor that configures the inverter INV34 in order that the voltage b reaches a threshold voltage or more at which the input-side inverter INV33 of the SM 126 is inverted to the "H" level. It is necessary to determine the transistor size of the switch SW32 and the transistor size of the NMOS transistor that configures the inverter INV34 in consideration of the ratio of the driving force.

When one-bit data stored in the SMs 125 are written in the SMs 126 of all of the pixels 12C all at once, the trigger pulse of the trigger pulse line trig becomes the "L" level, and the switches SW23 are turned OFF. Therefore, the SMs 126 hold the written one-bit data, and the potential of the reflection electrode PE can be fixed to a potential according to the held data during an arbitrary time (here, during one sub-frame period).

The data written in the SMs 126 are the normal data and the inverted data switched in every one sub-frame illustrated at (C) in FIG. 5. Meanwhile, the common electrode potential Vcom is alternately switched to a predetermined potential in every one sub-frame in synchronization with the above writing as illustrated at (D) in FIG. 5. According to the liquid crystal display device using the pixels 12C of the present embodiment, the AC drive in which the potential direction is inverted in every sub-frame is performed, similarly to the liquid crystal display devices using the pixels 12A or 12B of the above-described embodiments. Therefore, display in which the burning of the liquid crystal LCM is prevented can be performed. Further, according to the liquid crystal display device using the pixels 12C of the present embodiment, the driving force of the inverters INV31 and INV32 that configure the SM 125, the driving force of the inverters INV33 and INV34 that configure the SM 126, and the driving force of each transistor that configures the switch SW31 or SW32 are set to have the predetermined relations. Therefore, stable and accurate gradation display can be performed.

Note that the switches SW31 and SW32 may be configured from a PMOS transistor, and in that case, opposite polarities to the above description may just be considered, and thus description is omitted.

According to the present embodiment, a liquid crystal display device that enables downsizing of pixels in configuration and preventing a liquid crystal element from being deteriorated, while maintaining gradation performance without arranging a multiplexer that controls polarity inversion of a pixel electrode.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A liquid crystal display device comprising:

a plurality of pixels provided at intersection portions where a plurality of column data lines and a plurality of row scanning lines intersect with each other, wherein the pixel comprises:

a display element configured to be filled and enclosed therein with liquid crystal between a pixel electrode and a common electrode opposing each other;

a first switching unit configured to sample, through the column data line, each frame data of an input video signal for displaying the frame data using a plurality of sub-frames having a shorter display period than one frame period;

a first holding unit configured to form an SRAM together with the first switching unit, and to hold sub-frame data sampled by the first switching unit;

a second switching unit configured to output the sub-frame data held by the first holding unit; and a second holding unit configured to form a DRAM together with the second switching unit, configured of which stored content is rewritten by the sub-frame data held in the first holding unit and input through the second switching unit, and configured to apply output data to the pixel electrode;

a pixel control unit configured to repeat writing the sub-frame data into the first holding units in the plurality of pixels in units of rows, to turn ON the second switching units of all of the plurality of pixels by a trigger pulse after the sub-frame data have been written into all of the plurality of pixels, and to operate, for each sub-frame, to rewrite the stored content in the second holding units of the plurality of pixels with the sub-frame data that has been stored in the first holding units; and a common voltage generation unit configured to invert at a start of each sub-frame a polarity of a common voltage to be applied to the common electrode opposing to the pixel electrode and also invert the polarity of the common voltage at a start of a predetermined processing period of frame rate control which includes a plurality of one frame periods to invert the sub-frame data held in the first holding unit in accordance with the polarity of the common voltage.

2. The liquid crystal display device according to claim 1, wherein the polarity of the common voltage is inverted at the start of each frame in the predetermined processing period of frame rate control.

3. The liquid crystal display device according to claim 2, wherein the second holding unit is configured from a capacitor, and the second switching unit is configured from a transmission gate, switching of which is controlled by two trigger pulses having opposite polarities to each other.

4. The liquid crystal display device according to claim 2, wherein the first switching unit is configured from one first transistor, the first holding unit is configured from first and second inverters of which mutual output terminals are connected to input terminals of the other inverters, and between the first and second inverters, a driving force of a second transistor, which configures the first inverter on an input side when viewed from the first transistor, is set larger than a driving force of a third transistor, which configures the second inverter on an output side when viewed from the first transistor, and a driving force of the first transistor is set larger than the driving force of the third transistor that configures the second inverter.

5. The liquid crystal display device according to claim 3, wherein a multilayer wiring layer is formed above a substrate, on which surface two transistors that configure the transmission gate are formed, the capacitor is formed by an electrode formed between one intermediate wiring layer among the multilayer wiring layer and an interlayer insulation film, and the pixel electrode is formed by an uppermost wiring layer among the multilayer wiring layer.

6. The liquid crystal display device according to claim 1, wherein the second holding unit is configured from a capacitor, and the second switching unit is configured from a transmission gate, switching of which is controlled by two trigger pulses having opposite polarities to each other.

7. The liquid crystal display device according to claim 6, wherein a multilayer wiring layer is formed above a substrate, on which surface two transistors that configure the transmission gate are formed, the capacitor is formed by an electrode formed between one intermediate wiring layer among the multilayer wiring layer and an interlayer insulation film, and the pixel electrode is formed by an uppermost wiring layer among the multilayer wiring layer.

8. The liquid crystal display device according to claim 1, wherein the first switching unit is configured from one first transistor, the first holding unit is configured from first and second inverters of which mutual output terminals are connected to input terminals of the other inverters, and between the first and second inverters, a driving force of a second transistor, which configures the first inverter on an input side when viewed from the first transistor, is set larger than a driving force of a third transistor, which configures the second inverter on an output side when viewed from the first transistor, and a driving force of the first transistor is set larger than the driving force of the third transistor that configures the second inverter.

* * * * *